US008497885B2

(12) United States Patent
Ikeda et al.

(10) Patent No.: US 8,497,885 B2
(45) Date of Patent: Jul. 30, 2013

(54) DISPLAY APPARATUS AND DRIVE METHOD THEREOF

(75) Inventors: Kouji Ikeda, Chiba (JP); Kohichi Nakamura, Kawasaki (JP); Masami Iseki, Mobara (JP)

(73) Assignee: Canon Kabushiki Karsha, Tokyo (JP)

( * ) Notice: Subject to any disclaimer, the term of this patent is extended or adjusted under 35 U.S.C. 154(b) by 1070 days.

(21) Appl. No.: 12/520,726

(22) PCT Filed: Aug. 20, 2008

(86) PCT No.: PCT/JP2008/065230

§ 371 (c)(1),
(2), (4) Date: Jun. 22, 2009

(87) PCT Pub. No.: WO2009/025387

PCT Pub. Date: Feb. 26, 2009

(65) Prior Publication Data

US 2009/0289966 A1 Nov. 26, 2009

(30) Foreign Application Priority Data

Aug. 21, 2007 (JP) ..... 2007-214795
Sep. 4, 2007 (JP) ..... 2007-229248

(51) Int. Cl.
*G09G 5/10* (2006.01)

(52) U.S. Cl.
USPC ..... 345/690; 345/76; 345/77; 345/81; 345/82; 345/83; 315/169.3; 313/463

(58) Field of Classification Search
USPC ..... 345/94, 98–100, 89, 87, 204, 690, 345/76–83; 315/169.3; 313/463
See application file for complete search history.

(56) References Cited

U.S. PATENT DOCUMENTS 5,302,871 A 4/1994 Matsuzaki et al.
5,963,184 A 10/1999 Tokunaga et al.

(Continued)

FOREIGN PATENT DOCUMENTS

CN 1521719 A 8/2004
CN 1770246 A 5/2006

(Continued)

OTHER PUBLICATIONS

International Search Report and Written Opinion in PCT/JP2008/065230.

(Continued)

*Primary Examiner* — Lun-Yi Lao
*Assistant Examiner* — Shaheda Abdin
(74) *Attorney, Agent, or Firm* — Fitzpatrick Cella, Harper & Scinto

(57) ABSTRACT

A display apparatus includes a matrix of light emitting elements, a plurality of drive circuits provided for driving the light emitting elements, a plurality of scanning lines to which a scanning signal is applied to select the drive circuits on a row basis, a plurality of control lines to which a light-emission control signal is applied to determine an emission period of the light emitting elements, and a plurality of data lines to which image signals are applied to define brightness of the light emitting elements on a column basis. The scanning signal is sequentially applied to the scanning lines in a field so that the image signals of the data lines are programmed in the drive circuits, and the light-emission control signal is sequentially applied to the control lines to make the light emitting elements emit light with brightness corresponding to the image signal programmed to the drive circuit. An impulse operation, constituted by a high level and a low level of the light-emission control signal, corresponds to on and off of the light emission element, respectively, and is repeated at least twice in different temporal patterns in a period from programming of the image signal necessary for display of one image to inputting of the next image signal.

12 Claims, 14 Drawing Sheets

U.S. PATENT DOCUMENTS

| | | | | |
|---|---|---|---|---|
| 6,188,378 | B1 | 2/2001 | Yamamoto et al. | |
| 6,335,720 | B1 | 1/2002 | Mori et al. | |
| 6,348,910 | B1 | 2/2002 | Yamamoto et al. | |
| 6,373,454 | B1 | 4/2002 | Knapp et al. | |
| 6,552,709 | B1 | 4/2003 | Yamaguchi | |
| 6,559,824 | B1 | 5/2003 | Kubota et al. | |
| 6,587,086 | B1 | 7/2003 | Koyama | 345/77 |
| 6,661,180 | B2 | 12/2003 | Koyama | |
| 7,126,565 | B2 | 10/2006 | Kawasaki et al. | |
| 7,242,397 | B2 | 7/2007 | Iseki et al. | |
| 7,253,812 | B2 | 8/2007 | Sasaki | |
| 7,259,735 | B2 | 8/2007 | Kasai | |
| 7,532,207 | B2 | 5/2009 | Kawasaki et al. | |
| 7,605,899 | B2 | 10/2009 | Shikina et al. | |
| 7,692,643 | B2 | 4/2010 | Kawasaki et al. | |
| 7,812,812 | B2 | 10/2010 | Yoshinaga et al. | |
| 7,911,425 | B2 | 3/2011 | Goden et al. | |
| 2002/0047581 | A1 | 4/2002 | Koyama | 315/169.3 |
| 2003/0058687 | A1 | 3/2003 | Kimura | |
| 2003/0179221 | A1* | 9/2003 | Nitta et al. | 345/690 |
| 2004/0155841 | A1* | 8/2004 | Kasai | 345/76 |
| 2004/0155843 | A1 | 8/2004 | Sasaki | 345/76 |
| 2004/0183752 | A1 | 9/2004 | Kawasaki et al. | |
| 2005/0007316 | A1 | 1/2005 | Akimoto et al. | |
| 2005/0007319 | A1 | 1/2005 | Shin et al. | |
| 2005/0041002 | A1 | 2/2005 | Takahara et al. | |
| 2005/0122150 | A1 | 6/2005 | Iseki et al. | |
| 2005/0285151 | A1 | 12/2005 | Kawasaki | |
| 2006/0061529 | A1 | 3/2006 | Kim | 345/87 |
| 2006/0114194 | A1 | 6/2006 | Kawasaki et al. | |
| 2006/0114195 | A1 | 6/2006 | Yamashita et al. | |
| 2006/0132395 | A1 | 6/2006 | Kawasaki et al. | |
| 2006/0139289 | A1* | 6/2006 | Yoshida et al. | 345/98 |
| 2006/0187185 | A1 | 8/2006 | Yoshinaga et al. | |
| 2006/0267509 | A1 | 11/2006 | Yang | |
| 2007/0132719 | A1 | 6/2007 | Yamashita et al. | |
| 2007/0257867 | A1 | 11/2007 | Kasai | |
| 2007/0257868 | A1 | 11/2007 | Kasai | |
| 2008/0007494 | A1 | 1/2008 | Kim et al. | |
| 2008/0157828 | A1 | 7/2008 | Kawasaki et al. | |
| 2008/0158112 | A1 | 7/2008 | Kawasaki et al. | |
| 2008/0259000 | A1 | 10/2008 | Kawasaki | |
| 2009/0015571 | A1 | 1/2009 | Kawasaki et al. | |
| 2009/0033599 | A1 | 2/2009 | Kawasaki et al. | |
| 2009/0066615 | A1 | 3/2009 | Kawasaki | |
| 2009/0085908 | A1 | 4/2009 | Kawasaki et al. | |
| 2009/0102853 | A1 | 4/2009 | Kawasaki et al. | |
| 2009/0109144 | A1 | 4/2009 | Goden et al. | |
| 2009/0121980 | A1 | 5/2009 | Kawasaki et al. | |
| 2009/0135110 | A1 | 5/2009 | Nakamura et al. | |
| 2009/0231239 | A1 | 9/2009 | Goden et al. | |
| 2009/0289966 | A1 | 11/2009 | Ikeda et al. | |
| 2010/0026677 | A1 | 2/2010 | Shikina et al. | |
| 2010/0073267 | A1 | 3/2010 | Akimoto et al. | |
| 2010/0128160 | A1 | 5/2010 | Maru et al. | |
| 2010/0328365 | A1 | 12/2010 | Ikeda et al. | |
| 2011/0001689 | A1 | 1/2011 | Maru et al. | |
| 2011/0025653 | A1 | 2/2011 | Ikeda et al. | |
| 2011/0090210 | A1 | 4/2011 | Sasaki et al. | |

FOREIGN PATENT DOCUMENTS

| | | | |
|---|---|---|---|
| EP | 1 429 312 | A2 | 6/2004 |
| JP | 11-282417 | A | 10/1999 |
| JP | 2001-134229 | A | 5/2001 |
| JP | 2001-159877 | A | 6/2001 |
| JP | 2004-3411144 | A | 12/2004 |
| JP | 2005-157322 | A | 6/2005 |
| JP | 2006-30516 | | 2/2006 |
| JP | 2006-030516 | A | 2/2006 |
| JP | 2008-268981 | A | 11/2008 |
| JP | 2008-015516 | A | 12/2008 |

OTHER PUBLICATIONS

Korean Office Action dated Aug. 29, 2011, in related Korean Patent Application No. 10-2010-7005675.

Chinese Office Action dated Dec. 28, 2011, in related Chinese Patent Application No. 200880103102.9.

* cited by examiner

DISPLAY APPARATUS AND DRIVE METHOD THEREOF

TECHNICAL FIELD

The present invention relates to a display apparatus having self-luminous elements arranged in a matrix manner and a drive method thereof. In particular, the present invention relates to an active matrix display apparatus which provides a display using self-luminous elements such as electro-luminescence (EL) elements performing an impulse operation and an electric circuit for optionally controlling a light-emission period, and a drive method thereof.

BACKGROUND ART

Attention is being given to a slim type display apparatus using an organic EL as a self-luminous high-brightness display. This display apparatus, being self-luminous, requires no backlight unlike a liquid crystal display apparatus. The whole display panel can be slimmed to approximately 1 to 2 mm, thus attaining reductions in size and weight. In addition, there are advantages such as no limitation of a viewing angle, high response speed, high brightness, high contrast and low power consumption. Accordingly, the organic EL display is taken as a promising candidate of a next-generation display. The organic EL display has been applied to a small display for a mobile apparatus (portable information tools) such as a digital camera and a cellular phone. Furthermore, it is expected that the display will be applied to a middle- and large-sized display such as a PC monitor and a TV in the near future. An optimum display image is required to be realized in various use environments from dark places such as in rooms to open light places under the sun because mobile apparatuses can be easily carried regardless of indoor or outdoor. Further, for PC monitors and TVs as well, an optimum display image is required to be realized because they are used under various environments by users.

In a display apparatus such as CRT, liquid crystal or organic EL type, refresh operation of rewriting a video frame to be displayed a several tens of times per second is performed. The frame rewriting frequency is referred to as a refresh rate. When the fresh rate is low, flicker occurs. Accordingly, the refresh rate of these display apparatuses is usually a frequency (60 Hz) at which no flicker occurs. The liquid crystal display apparatus restrains flicker generation by a drive method of reversing a polarity of a voltage to be applied to a pixel electrode, for every frame with respect to a reference voltage, reversing a polarity for every horizontal pixel line or reversing a polarity for every display pixel.

An organic EL display apparatus uses a self-luminous display element for each pixel and emits light by passing electric current through respective light emitting elements to display an image. The brightness of a display screen can be set according to light-emission period occupied in one frame or light emission intensity. A difference between light emission (light portion) and non-light emission (dark portion) is made visible by a user, depending upon a frequency of light emission or a rate (duty ratio) of light-emission period to non-light-emission period in one frame. The difference is recognized as flicker of the display screen. Accordingly, even if display is made with the refresh rate of an image to be displayed being 60 Hz, the display screen flickers, depending upon duty ratio and hence display quality is degraded.

Increasing the refresh rate of a video to be displayed will generate no flicker. However, the operating speed of a drive circuit must be increased and, power consumption increases, and thereby members to be used, such as electronic parts and a drive circuit need a major change.

Japanese Patent Application Laid-Open No. 2006-030516 discloses a drive method of restraining flicker without increasing refresh rate in spite of a duty drive system which controls the brightness of a display screen according to the duty ratio of a light-emission period. This is a drive method which restrains flicker generation by dividing one frame into a plurality of sub frames by light-emission control and emitting light for only light-emission period corresponding to the duty ratio at the respective subframes.

As a drive method of making a gradation display by similar impulse operation, U.S. Pat. No. 6,587,086 discloses a sub field method in its specification. Multi-gradation display is made by dividing one field corresponding to one image into a plurality of subfields, setting a rate of a light emission maintenance period in the respective subfields to power of two and combining these subfields. By setting rates among light-emission maintenance periods of eight subfields SF1, SF2, . . . , SF8 to 1:2:4:8:16:32:64:128, respectively, 256 gradations can be attained in combinations of subfields.

As described in detail below, when impulse operation is performed at a fixed duty ratio with an active matrix type display apparatus, a lighting area moves with a fixed width from the upper to the lower portions of a screen, and a percentage of a lighting area to a non-lighting area occupied in the whole screen changes. Thus, a total current amount flowing into the display area changes with time, and the current change causes a change in power supply voltage because power supply impedance is not completely zero.

Upon the change in power supply voltage, the brightness of a screen changes as the whole and therefore a relationship between a change in power supply voltage and movement of the lighting area generates a phenomenon that a specific area of the screen is darker than the other areas. This brightness unevenness occurs fixedly in a specific area of the screen and therefore such a state cannot be eliminated even if an impulse operation frequency is increased, which degrades image quality due to a cause different from flicker.

Next, this phenomenon will be described in detail below. In the following description, the one field period is taken as a minimum unit period required until the next image data is input after the data required to display one image is input into a pixel for light emission. A period from completion of a row scanning period during a field period to completion of a field period is taken as a vertical blanking period.

FIG. 19 is a view illustrating a change in total current amount flowing into a display area while driving to provide a partially non-light-emission period, hereinafter referred to as "duty driving" in one field period (a total of one time vertical scanning period and vertical flyback time). TS signal is a light-emission control signal at a leading row in a display area and, if the signal is in Hi, light emission is made and if in low, non-light emission is made.

In the display area, there are provided pixels in a two-dimensional manner of m rows and n columns, where m and n are a natural number, respectively. Data is sequentially written into the pixels and a signal for selecting a writing row is scanned by m rows and TS signal is also sequentially scanned by respective rows.

The light emission pattern in FIG. 19 indicates impulse operation timing in a plurality of rows at uniform intervals within a display area. The leading row of the display area has the same light emission pattern as TS signal illustrated on the top of FIG. 19. Respective rows arranged at constant intervals delay light emission start by a scanning period of the interval compared with the leading row. The light emission patterns temporally-shifted in FIG. 19 illustrate light-emission periods of the leading row and a row following the leading row.

A broken line at the bottom of FIG. 19 shows a virtual light emission pattern of a "non-display area". Vertical scanning where light-emission periods are sequentially shifted is extended to a vertical blanking period. Assuming an area virtually scanned during the period, such an area is referred to as a "non-display area". No actually scanned or light emission rows exist during this period.

ΣI in FIG. 19 illustrates a sum of currents flowing into elements which are emitting light, that is, a total current amount (ΣI) flowing into a display area.

As illustrated in FIG. 19, ΣI changes depending on time. Changes in ΣI will be described in detail below.

FIG. 22 illustrates movement states (diagonal light and dark pattern) of a lighting area and a non-lighting area while a light emission area is moving from the top to the bottom of a display area, and brightness distribution (a graph below the light and dark pattern). FIG. 19 illustrates that the number of times of light emission is one within one field period, while FIG. 22 illustrates that the number of times is two within one field period.

A light and dark light emission pattern 101 illustrates that a position in a row scanning direction (a vertical direction in display area) is indicated in the horizontal direction and a time is indicated in a vertical direction. A white portion refers to light emission and a black portion refers to non-light emission. A graph of a light emission pattern in FIG. 19 corresponds to a light emission pattern 101 in FIG. 22 vertically cut.

A time change 102 of a total current ΣI is illustrated on the right of the light emission pattern 101. The vertical axis indicates time, which meets the time in the light emission pattern 101 within a display area. ΣI alternately repeats a period 105 when a large value is obtained and a period 106 when a small value is obtained. Reference numeral 103 denotes a vertical blanking period.

The number of lighting rows and the number of non-lighting rows are constant along a vertical direction (horizontal axis of 101) within a display area for a while after the leading row (left end of 101) of the display area changes from ON to OFF, and ΣI as well takes a constant value. During this period 105, two bands of lighting rows are moving from the top to the bottom of the display area. The number of lighting rows is more than that of non-lighting rows and a difference thereof is equal to the number of virtual scans within a vertical blanking period.

Then, with the leading row of the display area being OFF, when the final row changes from OFF to ON, subsequently the number of lighting rows decreases and the number of non-lighting rows increases. Thus, ΣI decreases. A decrease in the number of lighting rows and an increase in the number of non-lighting rows change with time at a constant rate and therefore ΣI shows a linear change with respect to time.

When the leading row enters a lighting period, the number of lighting rows and the number of non-lighting rows become constant again, respectively. This period 106 is a period when two bands of non-lighting rows move from the top to the bottom of the display area and therefore the number of lighting rows is less and the number of non-lighting rows is more than during the period 105. (The difference is still equal to the virtual number of scans during the vertical blanking period.) Accordingly, ΣI value is smaller than during the period 105.

Then, after the leading row of the display area maintains ON and the final row shifts to OFF, the number of lighting rows increases and the number of non-lighting rows decreases. Hence, ΣI increases.

The above is one cycle of ΣI time change. When a vertical blanking period exists in this way, a difference between lighting rows and non-lighting rows within a display area changes. This is a possible cause of a ΣI change.

A power supply has power source impedance of the apparatus's own. Accordingly, when ΣI changes, power supply voltage drops according to the product of the power source impedance and ΣI, thus causing a power supply change.

When power supply voltage drops, a change in brightness is caused. One of the possible causes is a current-voltage characteristic of a driving transistor. FIG. 20 illustrates Vds–Ids characteristic of driving TFT (Thin Film Transistor). In a case where a saturated area of TFT is used to drive a light emitting element, a voltage drop causes a current decrease by an early effect. Thus, a current flowing into a self-luminous element decreases to degrade brightness.

Another possible cause of brightness change is a current-voltage characteristic of the self-luminous element. FIG. 21 is a voltage-current characteristic of a typical organic EL device. When an applied voltage to a light emitting element such as an organic EL decreases, electric current also decreases to degrade brightness.

Depending upon configuration of a pixel circuit, there may be the case where an electric current flowing into the self-luminous element increases when a power supply drops, so that brightness may be enhanced, but here a case of a circuit configuration which decreases brightness with power supply drop is taken.

The lower portion of the light emission pattern 101 in FIG. 22 illustrates how brightness changes are seen on a display apparatus.

During a period of reference numeral 105, a total current amount is large and a power supply is in a dropping state and therefore the brightness of a light emission position during this period is low. During a period of reference numeral 106, a total current amount is small and a power supply is not in a dropping state and therefore the brightness of a light emission position during this period is higher than those of any other positions. The result obtained when these changes in brightness are integrated within a field period is denoted by a reference numeral 104. The time changes of ΣI by a light emission pattern are synchronous with movement of the light emission pattern and therefore brightness degrades at a specific position in a row scanning direction and looks like a light and dark pattern the position of which is fixed on the display screen. Such unevenness of brightness degrades image quality.

The degree of the brightness changes is determined by integration of a plurality of factors such as the magnitude of power source impedance, sensitivity of a pixel circuit against voltage drop, influence of TFT characteristics and efficiency of a self-luminous element.

FIG. 23 illustrates ΣI of a display apparatus light-emitted in a light emission pattern of FIG. 22 and time changes in light emission brightness of respective positions (1) to (4). Specifically, FIG. 23 illustrates light-emission control signal TS, total current amount ΣI flowing into a display area depending upon light emission timings, light emission timing of positions (1) to (4) in a specific row within a display area, then brightness and respective time changes. For light emission timing and brightness, a Low level indicates OFF, a High level indicates light emission and a Medium level indicates slightly dark light emission, and a slanting line illustrates gradually changing brightness.

Position (1) illustrates a state of light emission at the leading row of a display area and is almost the same light emission pattern as TS signal. Positions (2) to (4) illustrates a state of light emission at a position downwardly shifted by each ¼ in the vertical direction of the display area from Position (1), respectively. As a row is shifted by row scanning, light emission start of TS signal delays by the time and, as illustrated, a light emission timing changes depending upon row. With attention focused on changes in ΣI, a small ΣI period 106 in FIG. 22 corresponds to periods P1, P2, P1', P2' in FIG. 23.

At Position (1) light emission starts immediately after field period start and, as illustrated in FIG. 22, a first half (P1 period) of the light-emission period is a period at which ΣI is small and constant and power supply voltage is kept high and therefore light emission is made with high brightness. However, with an increase in ΣI from midway, power supply voltage drops, and therefore light emission brightness decreases. A second light emission is made in the same light emission pattern.

At position (2) light emission starts at a high ΣI position and therefore light emission is made with slightly low brightness. Subsequently, brightness rises a little with lowering of ΣI. The second light emission is made in the same light emission pattern.

Light emission start timings of Position (3) and Position (4) delay by a ½ field period from those of Position (1) and Position (2), but the light emission pattern is exactly the same.

At Position (2) and Position (4), rising ΣI changes and light-emission period synchronize with each other and therefore there is hardly a period of high light emission. Accordingly, a large difference in light emission amount at respective rows integrated in a certain period (e.g. one field period) occurs and a brightness change occurs in a row direction within the display area, thus degrading image quality.

DISCLOSURE OF THE INVENTION

An aspect of the present invention is to provide a display apparatus and a drive method thereof, performing periodical impulse operation, capable of excellent display by suppressing degradation of image quality caused by power supply fluctuations described above.

According to a first aspect of the present invention, a display apparatus includes:

a plurality of light emitting elements arranged in a row direction and in a column direction;

a plurality of drive circuits each provided for driving each of the light emitting elements;

a plurality of scanning lines extending in the row direction, to which a scanning signal is applied to select the drive circuits on the row basis;

a plurality of control lines extending in the row direction, to which a light-emission control signal is applied to determine a emission period of the light emitting elements; and a plurality of data lines extending in the column direction, to which image signals are applied to define brightness of the light emitting elements on the column basis, the scanning signal being sequentially applied to the scanning lines in a field so that the image signals of the data lines are programmed in the drive circuits, the light-emission control signal being sequentially applied to the control lines to make the light emitting elements emit light with brightness corresponding to the image data programmed to the drive circuit, wherein an impulse operation constituted by a high and a low levels of the light-emission control signal, which correspond to on and off of the light emission element, respectively, are repeated at least twice in different temporal patterns in the field.

According to the first aspect of the present invention, the display apparatus of the present invention performs impulse operation to suppress flicker while performing duty drive and determines a light-emission period and light emission start timings with phases of a light-emission period and power fluctuation period being shifted from each other. Thus, the self-luminous element can suppress to make light emission only at a timing when a power supply drops or only when a power supply is high. Specifically, light emission is made at a timing when a power supply drops and a timing when the power supply does not drop, and therefore brightness uniformity is improved within a display area, thus attaining excellent display.

On the premise that power source current fluctuates with time, the first aspect of the present invention is intended for eliminating unevenness of brightness caused by the fluctuation. On the other hand, another aspect of the present invention is intended for providing a display apparatus and a drive method having means for eliminating fluctuations in power source current.

According to another aspect of the present invention, a display apparatus includes: light emitting elements arranged in a row direction and in a column direction; a drive circuit provided in each of the light emitting elements to drive the light emitting elements; a scanning line which is supplied with a scanning signal to select the drive circuit on the row basis; a control line which is supplied with a light-emission control signal to control a period during which the drive circuit drives the light emitting element; and a data line for supplying an image signal to the drive circuit arranged in the column direction, wherein the scanning signal is sequentially applied to the scanning line at a period of one field so that an image signal of the data line is programmed in the drive circuit, and wherein the light-emission control signal is applied to the control line at a timing shifted on the row basis so that the light emitting element emits light, and wherein a light emission pattern of the light emitting element corresponding to a waveform of the light-emission control signal in the one field includes an impulse operation period of 1/M (M: natural number) of a vertical blanking period.

This invention provides a display apparatus and a drive method thereof, for performing periodical impulse operation to suppress flicker while performing duty drive. By determining an impulse operation period based on a field period and a row scanning period, a change of ΣI (a total current amount flowing into display area) can be suppressed, thus suppressing power source fluctuations even if there is power supply impedance which is not zero and is finite. Hence, excellent display can be made by suppressing degradation in image quality due to a brightness change caused by power source fluctuations.

The present invention relates to a display apparatus with self-luminous elements arranged in a matrix manner and a drive method thereof. In particular, the present invention relates to an active matrix display apparatus which effects displaying by using a self-luminous element such as electroluminescence (EL) element having an impulse operation function and an electric circuit for optionally controlling a light-emission period, and a drive method thereof.

Using this display apparatus, for example, an information display apparatus can be constructed. The information display apparatus can take any form of, for example, a cellular phone, a portable computer, a still camera and a video camera, or an apparatus which implements a plurality of functions thereof. The information display apparatus includes an information input unit. For example, in the case of a cellular phone, the information input unit includes an antenna. In the case of PDA and a portable PC, the information input unit includes an interface unit for a network. In the case of a still camera or a movie camera, the information input unit includes a sensor unit with CCD, CMOS or the like.

Further features of the present invention will become apparent from the following description of exemplary embodiments with reference to the attached drawings.

BEST MODE FOR CARRYING OUT THE INVENTION

Preferred embodiments of the present invention will now be described in detail in accordance with the accompanying drawings.

"Impulse operation period" used herein refers to one continuous period including one lighting period and one non-lighting period. Lengths of lighting and non-lighting periods in one impulse operation period may not always the same. A rate of a lighting period in one impulse operation period is referred to as a "duty ratio".

In addition, "light emission pattern" used herein refers to a method for section division and switching timing in dividing one field period into several sections and alternately switching lighting period and non-lighting. The lighting period and the non-lighting period in this case refer to a section capable of light emission to be controlled on the row basis and a section of light emission prohibition without depending upon display signals of respective pixels. The light emission pattern has one pattern divided into two: a first half is for lighting and a second half for non-lighting.

All periods to be controlled on the row basis, such as vertical scanning period, blanking period, lighting period, non-lighting period and impulse operation period are shown in a unit of a scanning period of one row, referred to as 1H. Hence, all thereof are integers.

In addition, "period is approximately 1/M (M: natural number) of a vertical blanking period" or "light emission pattern is taken as approximately 1/N (N: natural number) of one field period" means that, if the period has a fractions smaller than one row scanning period, it is rounded off, rounded up or omitted to an integer. A description without a word "approximately" means not only an exact value but also any value falling within a range of fractions of less than 1H around the exact value.

Referring to the accompanying drawings, detailed description will be made on an exemplary embodiment of a display apparatus of the present invention below, in the first to fifth embodiments. This exemplary embodiment relates to a drive method which is applied to an active matrix display apparatus using an EL element and provides excellent display while performing an impulse operation. Respective embodiments describe an organic EL display apparatus using an EL element as an example, respectively, but a display apparatus according to the present invention is not limited thereto, and is favorably applied, provided that the apparatus can control light emission of a self-luminous element. In the display apparatus according to the present invention, the light emission intensity of the EL element as a light emitting element is determined by an image signal.

First Embodiment

Figure 1:
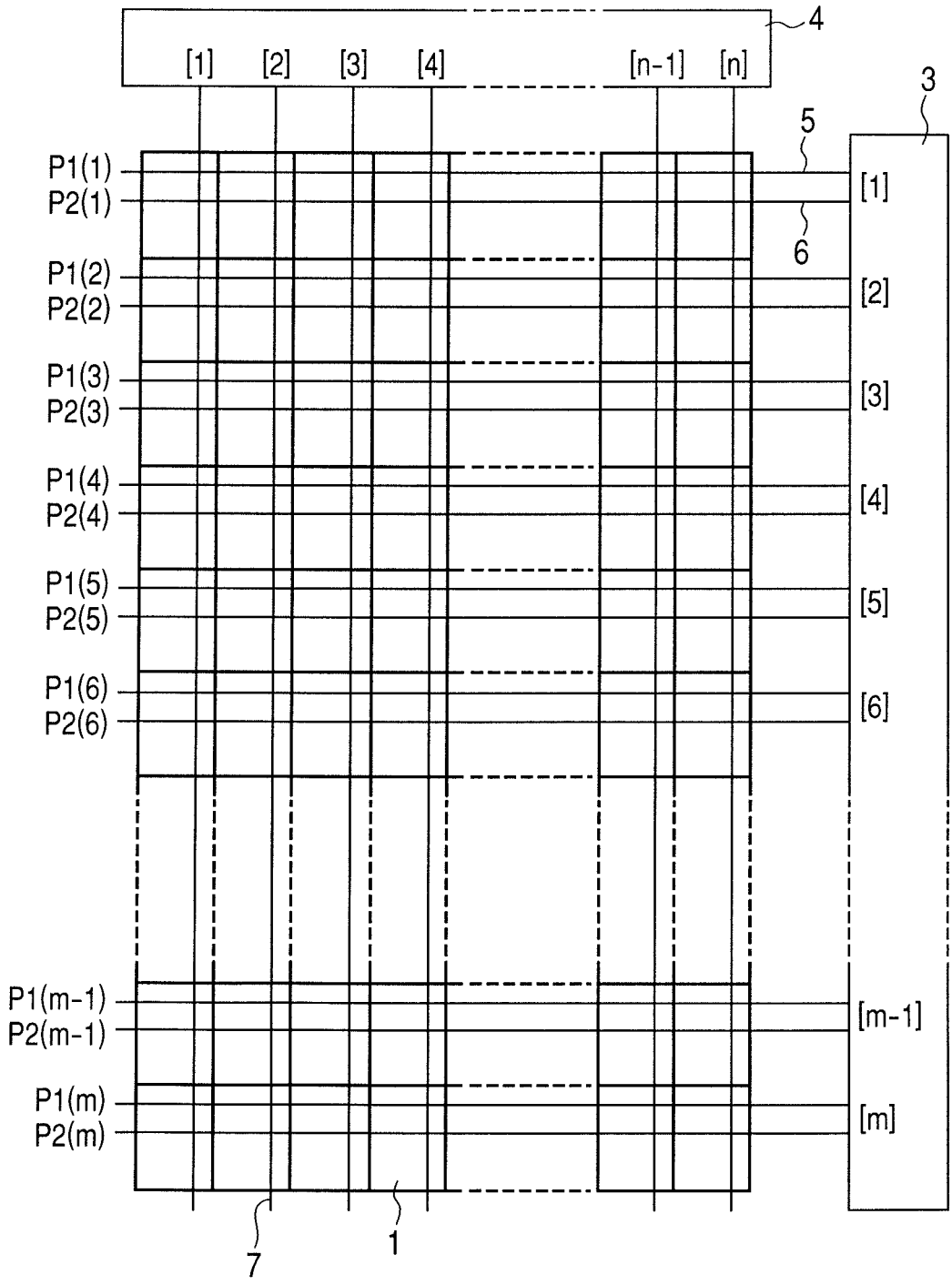
FIG. 1 is a view illustrating one example of a display apparatus according to the present invention.

FIG. 1 illustrates an overall configuration of a display apparatus according to the present invention.

In FIG. 1, an image display unit is arranged with pixels 1 two-dimensionally in the row and column directions. The number of rows is taken as m and the number of columns is taken as n.

Each of the pixels 1 includes EL elements of RGB primary colors and pixel circuits 2 (refer to FIG. 2) which are provided to the respective EL elements and control an electric current to be input. The pixel circuit 2 is a circuit including a thin film transistor (TFT).

Around the image display unit, a row control circuit 3 and a column control circuit 4 are provided. From respective output terminals of the row control circuit 3, scanning lines 5 and control lines 6 for controlling light emission extend to the row direction. Scanning signals P1(1) to P1(*m*) and light-emission control signals P2(1) to P2(*m*) are supplied to these scanning lines 5 and control lines 6, respectively. The scanning signals are sequentially input into the pixel circuits 2 at respective rows through scanning lines 5. The light-emission control signals are sequentially input into the pixel circuits 2 at respective rows through control lines 6.

Data lines 7 are output from the row control circuit 4 and extend to the column direction. A voltage signal Vdata is output from respective output terminals of the row control circuit 4 and supplied to the data line 7. The voltage signal Vdata is input into the pixel circuits in the column via data lines 7. Hereafter, the voltage signal Vdata is referred to an image signal.

Figure 2:
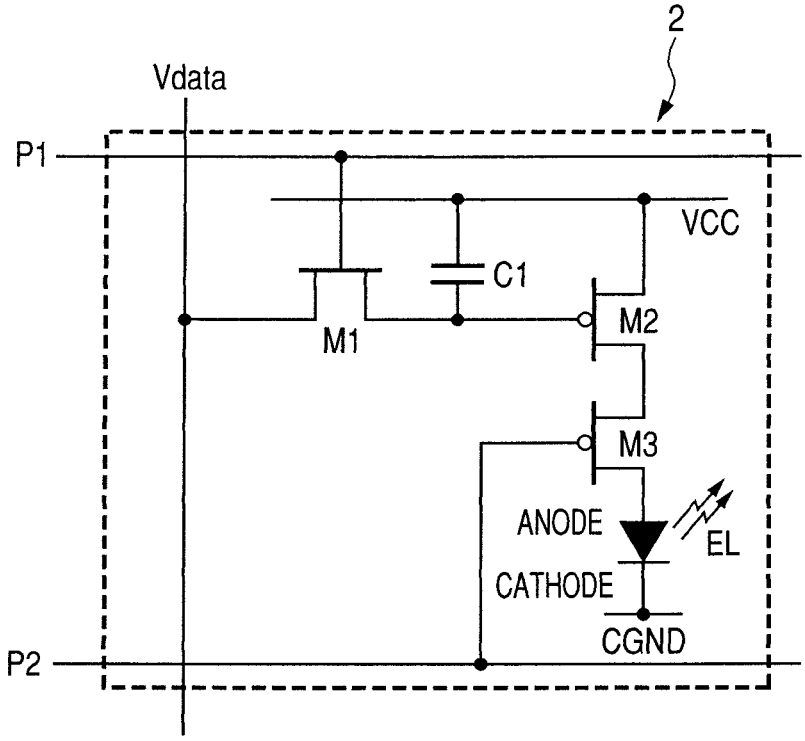
FIG. 2 is a view illustrating one example of a pixel circuit in a display apparatus according to the present invention.

FIG. 2 illustrates a configurational example of a pixel circuit 2 including an EL element of the present embodiment.

In FIG. 2, P1 is a scanning signal and P2 is a light-emission control signal. The vertical line is a data line on which an image signal Vdata is applied. An anode of the EL element is connected to a drain terminal of TFT (M3) and a cathode is connected to a ground potential CGND. M2 and M3 are a P type TFT, respectively and M1 is an N type TFT.

Figure 3:
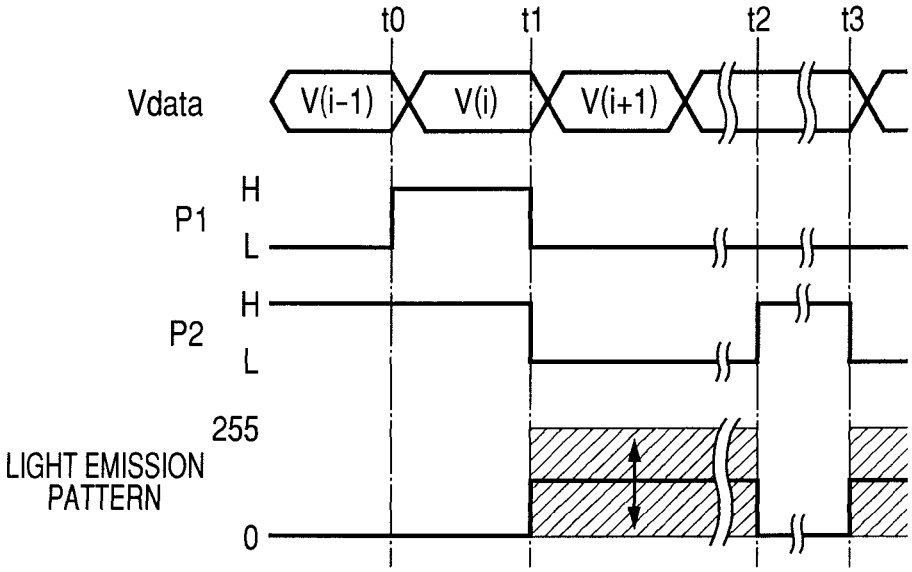
FIG. 3 is a timing chart illustrating operation of the pixel circuit in FIG. 2.

FIG. 3 is a timing chart illustrating a drive method of the pixel circuit 2.

In FIG. 3, V(i−1), V(i), V(i+1) show a voltage data Vdata input into a pixel circuit 2 at subject rows of row (i−1) (a row preceding by one row), row i (a subject row) and row (i+1) (a next row) in a field unit.

First, before a time t0, in the pixel circuit 2 at a subject row, a low-level signal is input as a scanning signal P1 and a high-level signal is input as a light-emission control signal P2. In addition, a transistor M1 is OFF and M3 is OFF. Under this state, V(i−1) corresponding to an image signal Vdata at a row preceding by one row is not input into the pixel circuit 2 at an m-th row which is a subject row.

At a time t0, a high-level signal is input as P1 and a high-level signal is input as P2 and the transistor M1 is turned ON and M3 is turned OFF. Under this condition, V(i) corresponding to an image signal Vdata at a corresponding row is input into the pixel circuit 2 at an m-th row. A voltage of the input Vdata is charged into a capacitor C1 disposed between an M2 gate terminal and a power supply potential VCC.

A series of operations of applying a scanning signal P1 into a pixel circuit, making the pixel circuit fetch an image signal Vdata from a data line and retaining the data into a capacitor C1 are referred to as "programming". The programming is executed on the row basis.

Next, at a time t1, a low-level signal is input as the P1 and a low-level signal is input as the P2 and the transistor M1 is turned OFF and M3 is turned ON. Under this state, M3 is in a conductive state and therefore an electric current corresponding to the current driving capacity of M2 is supplied to the EL element due to the voltage charged in C1. This allows the EL element to make light emission in such a light emission pattern as illustrated in FIG. 3 with gradation brightness corresponding to a supplied current.

Then, a time t2, a signal at a high level is input as the P2 and M3 is turned OFF, and current supply to the EL element is stopped so that a non-light emission state appears. P2 controls lighting period by changing a low-level period and a time at which a low level is made.

Next, at a time t3, a low-level signal of the P2 is input and M3 is turned ON, and current is supplied to the EL element to be in a light emission state. The P2 controls a non-light-emission period by changing a high-level period. A set of continuous periods designated from a time t1 to a time t3, including a period in which P2 is in a low-level period and a period in which P2 is in a high-level period, is one impulse operation period. Hereafter, a set of a low and a high level is referred to "a temporal pattern" of the impulse operation.

A period when P1 is a high-level signal from t0 to t1 is a time that takes to perform one row scanning, which is referred to as "one horizontal scanning period". A sequential scanning signal P1 is applied over the whole scanning line to complete programming for all pixels. A time required to complete all-row scanning is referred to as "one vertical scanning period".

After completion of all-row scanning, the following scanning is repeated through a dormant period (vertical blanking period). The repeated period is one field period.

In the present embodiment, as a pixel circuit, a configuration of FIG. 2 has been described as one example, but the present invention is not limited thereto.

Figure 4:
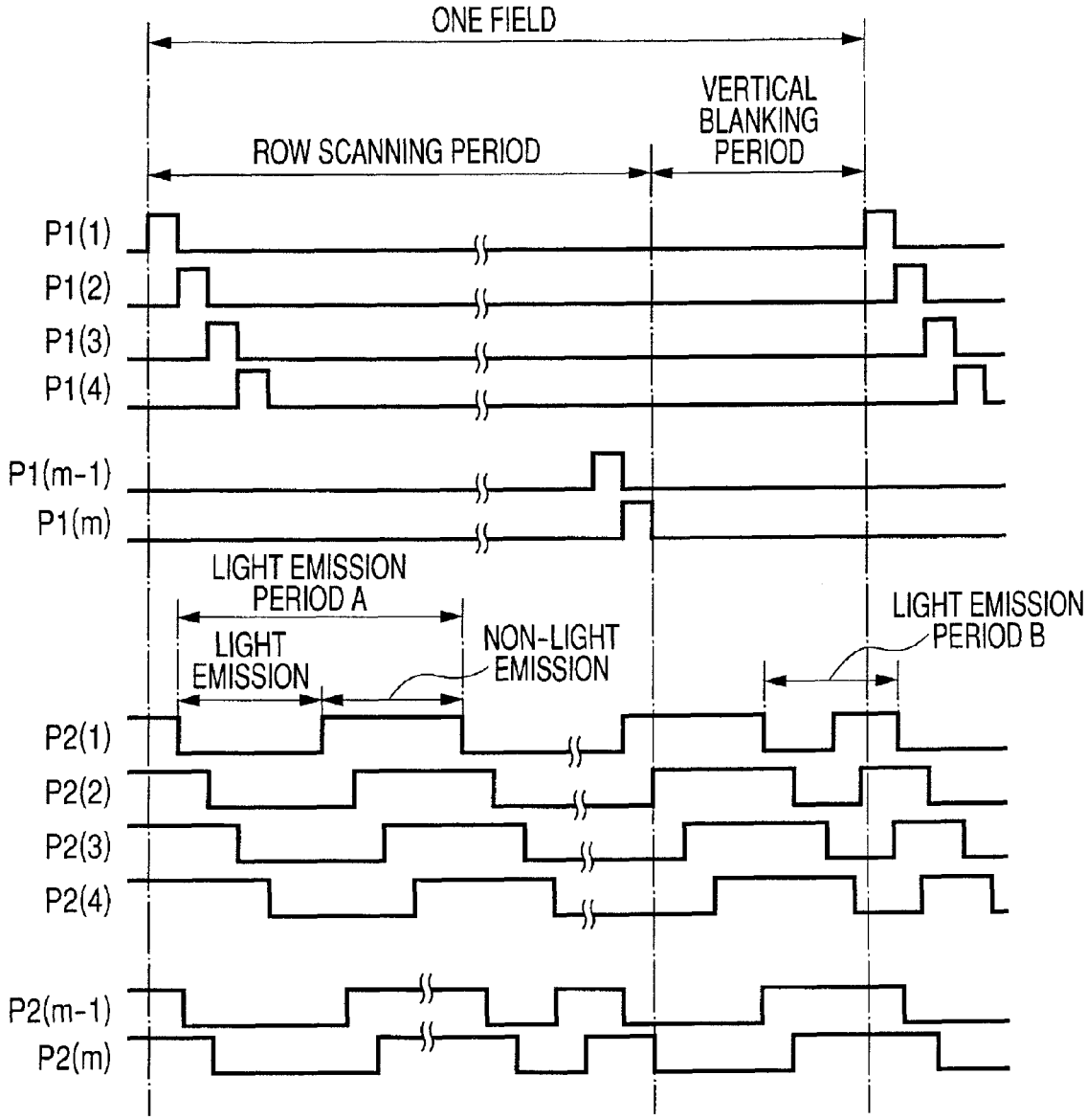
FIG. 4 is a timing chart illustrating operation of the display apparatus in FIG. 1.

FIG. 4 is an example of a timing chart illustrating a drive method of the display apparatus in the present invention.

In FIG. 4, P1(1) to P1(*m*) show a scanning signal P1 corresponding to each of 1st to m-th rows. P2(1) to P2(*m*) show a light-emission control signal P2 corresponding to each of 1st to m-th rows.

In a row scanning period, scanning signals P1(1), P1(2), P1(3), . . . P1(*m*) of 1st to m-th rows are sequentially shifted to a high level on the one scanning period basis. In the high level period, an image signal Vdata is input into a pixel circuit 2.

The light-emission control signal P2, after an image signal Vdata is input, is kept in a low-level period for light emission. Then, a high-level period is made for non-light emission. A sum of one light-emission period and one non-light-emission period is an impulse operation period and during a field period, light emission and non-light emission are repeated.

In this way, the light emitting element emits light at a timing when a light-emission control signal P2 is in a low level. An on-off sequence of a light emitting element, that is, a light emission pattern is determined by a waveform of the light-emission control signal P2 in one field period.

In an example of FIG. 4, after an impulse operation period A (a first impulse operation period) is repeated once or a plurality of times, the last impulse operation period in one field period is shorter than those of the others and therefore is set at an impulse operation period B (a second impulse operation period).

Specifically, in the present embodiment, one field period includes a plurality of impulse operation periods having different lengths.

Figure 5:
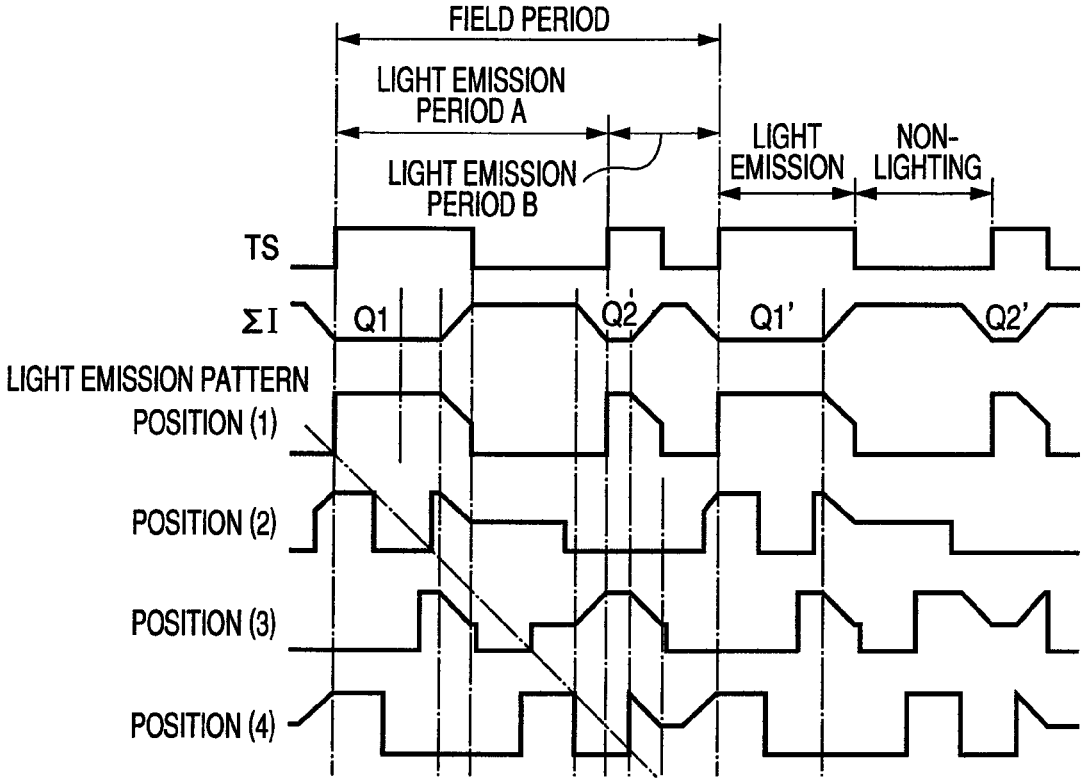
FIG. 5 is a view illustrating one example of a light emission pattern, power source fluctuation and brightness change in a drive method according to the present invention.

FIG. 5 illustrates a state in which one field period includes one impulse operation period A and one impulse operation period B shorter than A respectively, as one of present embodiments. Specifically, FIG. 5 illustrates a light-emission control signal TS and total current amount ΣI flowing into a display area. In addition, FIG. 5 illustrates light emission timings of Positions (1) to (4) at a specific row in a display area, brightness at each timing and time changes thereof.

Position (1) shows a state of light emission at the leading row of a display area and has the same light emission pattern. Each of the positions (2) to (4) shows a state of light emission at a position shifted downward by m/4 rows. When a row is shifted by row scanning, light emission start in a TS signal is delayed due to the row scanning period and a light emission timing is changed by the row as illustrated in FIG. 5.

In Position (1), light emission starts immediately after field period start and, in ΣI, a period of Q1 is a period having small power source fluctuations and therefore light emission is made with high brightness. However, with an increase in ΣI from midway, power supply voltage drops, and light emission brightness decreases. Subsequently, after lapse of a non-lighting period, a light-emission period is short even in impulse operation period B, but a light emission is made in the same light emission pattern. In Position (2), a light emission starts at the final stage of Q1 period and is made with high brightness. With an increase in ΣI, brightness decreases immediately and, when ΣI becomes stable at a high position, a stable light emission is made with slightly low brightness. A second light emission corresponding to a pulse of an impulse operation period B is made almost in a Q1' period of the next field and a bright light emission is made. Also in Positions (3) and (4), a light emission is made with brightness changing according to ΣI fluctuations.

Figure 23:
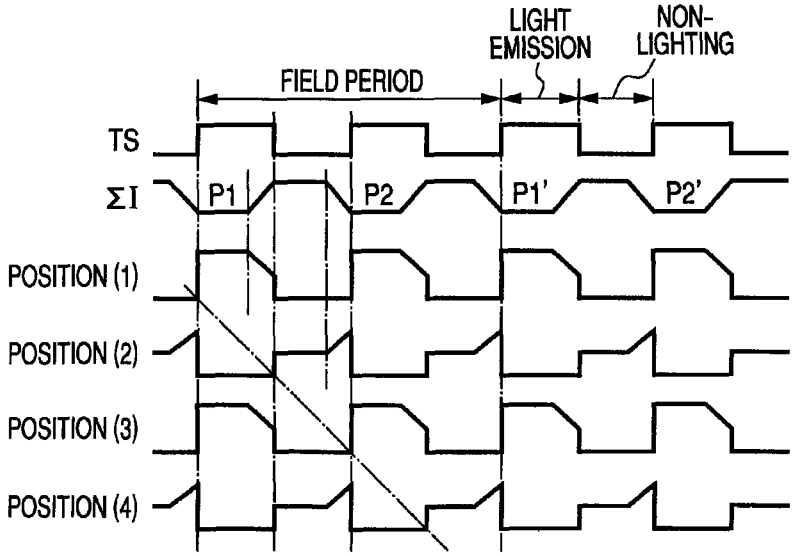
FIG. 23 illustrates power fluctuations and brightness changes at different positions of a display apparatus.

In a drive method in which an impulse operation period is equal, a period having a large ΣI value meets a light-emission period at a specific position as illustrated in Positions (2) and (4) in FIG. 23, and a period having a small ΣI value meets the light-emission period at another specific position as illustrated in Positions (1) and (3), and a large difference in brightness occurs therebetween. By changing a length of an impulse operation period, driving is performed by shifting ΣI fractions and phase of a light emission pattern to avoid synchronization, and therefore a period at least in which a bright light emission is made is allowed to be present at any row. Hence, a difference between light emission amounts at respective rows integrated by a certain time (e.g. one field period) is restrained and changes in brightness within a display area can be restrained, thus obtaining excellent image quality.

Figure 6:
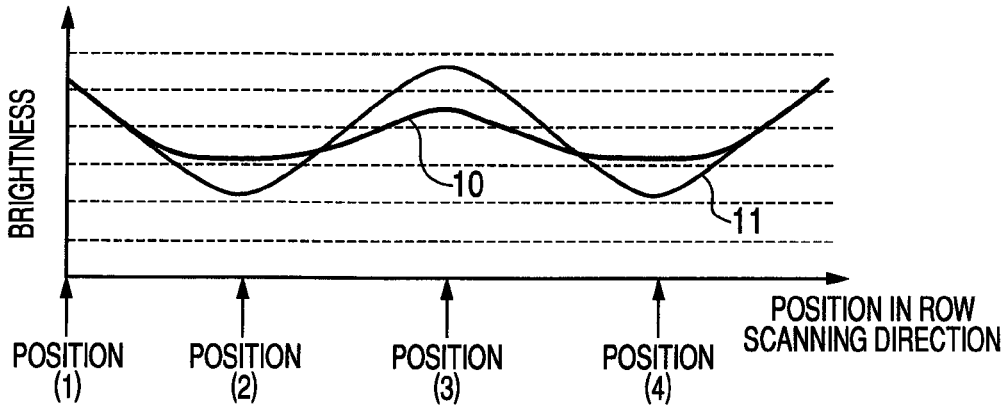
FIG. 6 is a view illustrating one example of brightness changes during driving in FIG. 5.

FIG. 6 illustrates changes in brightness in row direction within a display area including Positions (1) to (4). Reference numeral 10 denotes a brightness fluctuation of the present embodiment and reference numeral 11 denotes a brightness fluctuation when an impulse operation period is equal. It can be seen from FIG. 6 that the present embodiment restrains brightness fluctuation.

The present embodiment has been described for a display apparatus with a configuration in FIG. 1, but is not limited thereto. It may be a configuration capable of implementing a drive method in which different impulse operation period lengths exist in a field period as illustrated in FIG. 4 or FIG. 5.

FIG. 5 illustrates that a duty ratio is approximately 50%, but if different impulse operation period lengths exist in the field period, a rate of a light-emission period (duty ratio) in respective impulse operation periods may be any percentage.

Where duty ratios of respective impulse operation periods are the same, a sum of light-emission periods is kept even if an impulse operation period is changed and therefore brightness hardly changes. Accordingly, setting of duty ratios allows brightness to be easily changed except for gradation, which is more preferable. However, when the present embodiment is implemented with a logic circuit, adjustment of a light-emission period is required so that a count value of a light-emission period becomes an integer, for example, in a case where a count value of the light-emission period calculated from a duty ratio is not an integer. Accordingly, even if the duty ratio is not completely the same, it means no degradation in convenience described above.

As described above, the present invention includes a light-emission control signal so that different impulse operation period lengths exist in a field period. Accordingly, synchronization of light emission timings at respective rows with ΣI is suppressed, so that the number of rows which make emission only with low brightness in most light-emission periods can be reduced. Specifically, timings of light emission at high brightness can be distributed to most rows in a display area. Accordingly, a difference between brightness at respective rows is suppressed and a brightness change in a display area is suppressed, thus attaining excellent display.

Second Embodiment

The overall configuration of a display apparatus according to the present embodiment is the same as that of FIG. 1. A pixel circuit 2 and a drive method therefor are the same as those of FIGS. 2 and 3 and therefore description and drawings thereof will be omitted.

Figure 7:
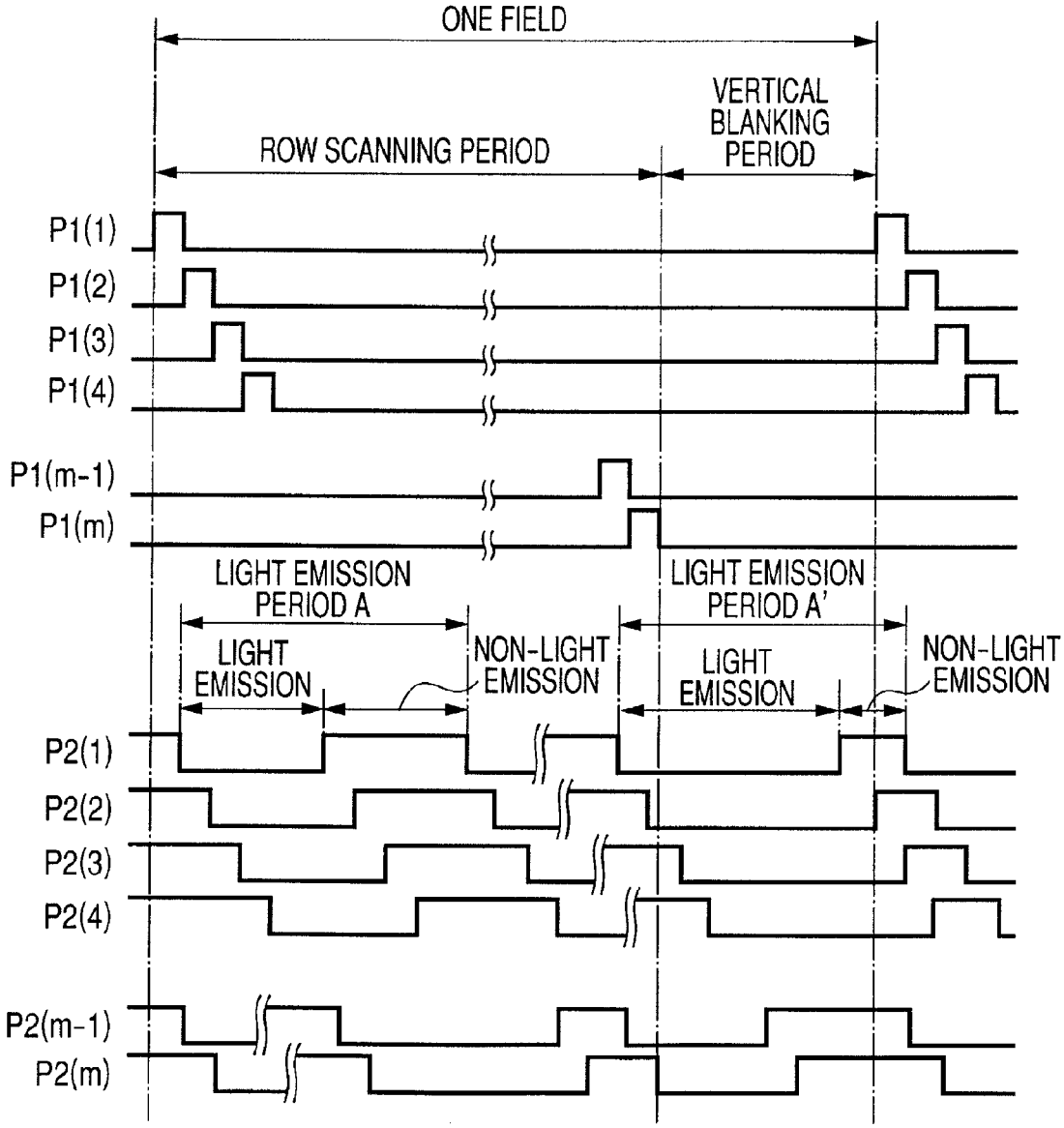
FIG. 7 is a timing chart illustrating another example of operation of the display apparatus in FIG. 1.

FIG. 7 is a timing chart illustrating another example of drive method of the display apparatus according to the present invention.

In FIG. 7, P1(1) to P1(*m*) show a scanning signal P1 corresponding to each of 1st to m-th rows. P2(1) to P2(*m*) show a light-emission control signal P2 corresponding to each of 1st to m-th rows. A difference from the drive method described in the timing chart illustrated in FIG. 4 is a waveform of a light-emission control signal P2.

The light-emission control signal P2 in the present embodiment is set to a waveform for driving at least one light-emission period in a light emission pattern different from other light-emission periods. Otherwise, the light-emission control signal P2 is set to a waveform for driving at least one non-lighting in a light emission pattern different from other non-light-emission periods.

In FIG. 7, a waveform as one example is set so that the lengths of impulse operation periods A, A' are equal and a light-emission period of an impulse operation period A' in a field period is longer than others. As other examples, the lengths of the impulse operation periods A, A' may be made different.

Figure 8:
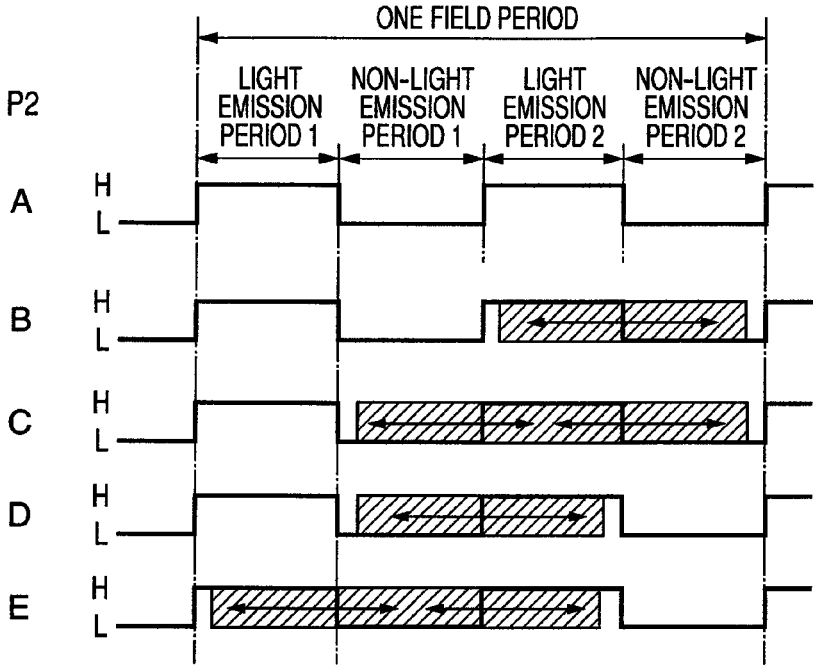
FIG. 8 is a view illustrating another example of the light emission pattern according to the timing chart in FIG. 6.

As another example in the present embodiment, FIG. 8 illustrates an example of another pattern of the light-emission control signal P2. "A" denotes a waveform which is a periodical light emission pattern illustrated for comparison.

"B" denotes an example of a waveform obtained by changing a light emission completion timing within a shaded range in the figure with a light emission start timing of the light-emission period 2 being maintained. The length of the light-emission period 2 may be changed within the range in which non-light-emission period 2 is not missing. "C" denotes an example of a waveform obtained by changing both of a second light emission start timing and light emission completion timing within a shaded range in the figure to change the length of the light-emission period. "D" denotes a waveform obtained by changing a light emission start timing within a shaded range in the figure with the second non-light start timing maintained to change the length of the first non-light-emission period. The length of the non-light-emission period 1 may be changed within a range in which light-emission period 2 is not missing. "E" denotes an example of a waveform obtained by changing both of a first light-emission period completion timing and a second light-emission period start timing within a shaded range in the figure to change the length of the first non-light-emission period.

FIG. 8 illustrates an example of the light-emission period existing only twice in a field period, but the light emission and non-light-emission periods may be provided N times (N: natural number), respectively.

The light-emission period or non-light-emission period may be provided at any time in a field period and lengths or timings of (N−1) light-emission periods at the maximum may be changed independently. In addition, the lengths or timings of (N−1) non-light-emission periods at the maximum may be changed independently. Further, the lengths or timings of (N−1) light-emission periods at the maximum and (N−1) non-light-emission periods at the maximum may be changed independently.

When the length of the light-emission period or non-light-emission period is changed, brightness also changes by an amount corresponding to a change in the light emission time. Accordingly, in making light emission at a desired duty ratio using a drive method of the present embodiment, a pattern of a light-emission control signal corresponding to a desired duty ratio may be recorded in advance in a storage element or the like to output, at making light emission, a light-emission control signal using a pattern corresponding to a duty ratio.

As described above, the light-emission control signal P2 in the present embodiment sets to a waveform for driving at least one of at least one light-emission period and at least one non-light-emission period with a light emission pattern different from that in the other light-emission periods. Hence, ΣI time change, that is, synchronization of power source fluctuations with light emission pattern can be suppressed. A bright light-emitting timing can be distributed to respective rows in the display area. Accordingly, a difference in brightness between respective rows can be suppressed, thus attaining excellent display.

Third Embodiment

The overall configuration of a display apparatus according to the present embodiment is the same as that of FIG. 1. A pixel circuit 2 and a drive method therefor are the same as those of FIGS. 2 and 3 and an example of a timing chart describing the drive method is the same as those of FIG. 4 and therefore description and drawings thereof will be omitted.

Figure 9:
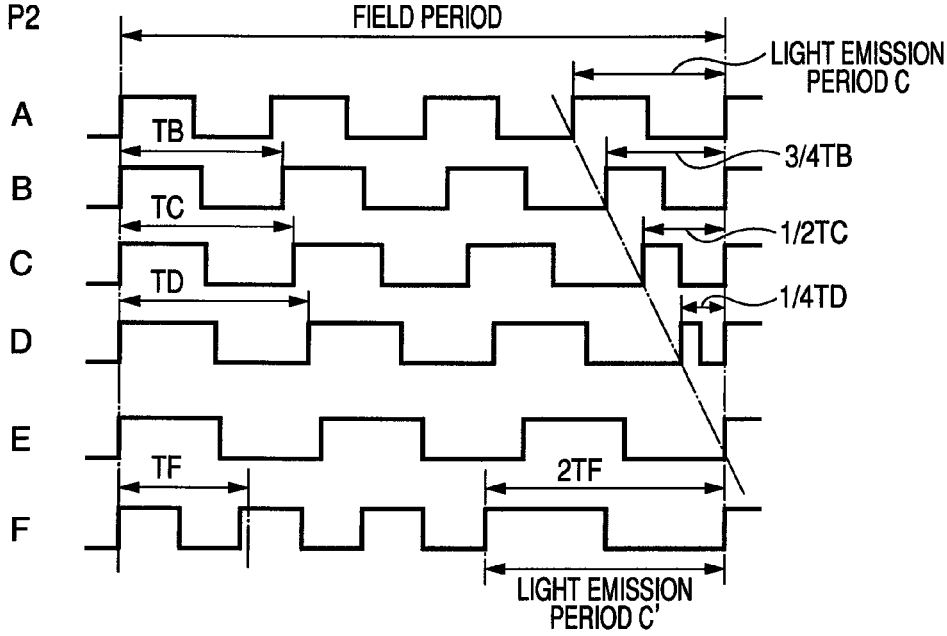
FIG. 9 is a view illustrating a light emission pattern of a drive method according to the present invention.

FIG. 9 illustrates a waveform of a light-emission control signal P2 having a plurality of impulse operation periods in a field period, in which patterns A to E in one of impulse operation periods (impulse operation period C) are changed to be short and pattern F is changed to be long, with a duty ratio being maintained. The lengths of other impulse operation periods change by an amount corresponding to a change in the length of the impulse operation period C. "A" denotes that impulse operation periods are all equal. "C" denotes that an impulse operation period C has an approximately half length as large as other impulse operation periods. "E" denotes that there is no impulse operation period C and other impulse operation periods are all equal. "F" denotes that an impulse operation period C has a length approximately twice as large as other impulse operation periods.

Figure 10:
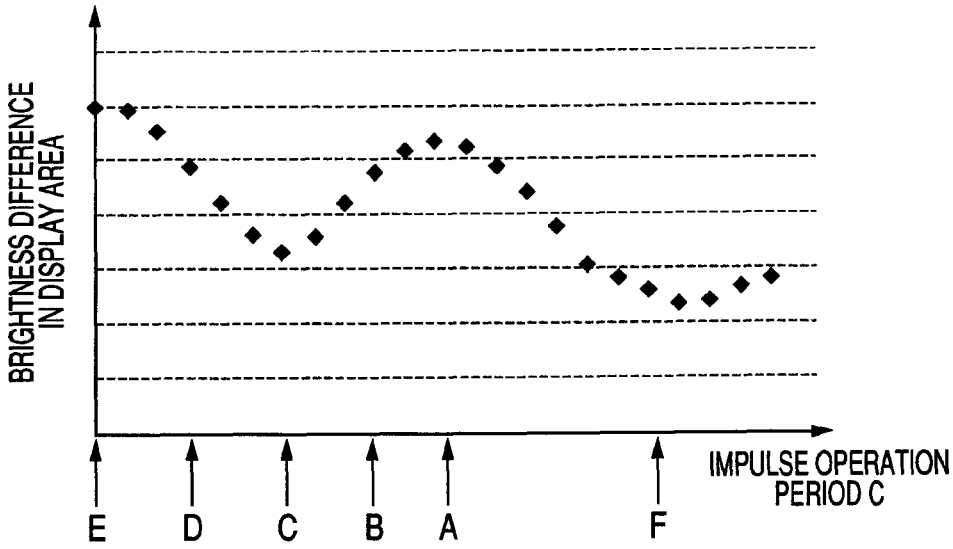
FIG. 10 is a view illustrating one example of technological advantages of the present invention attained by driving of FIG. 9.

FIG. 10 graphs a calculation result of in-plane brightness differences in a display area when driving in FIG. 9 is performed. The horizontal axis and the vertical axis show the length of impulse operation period C and the in-plane brightness difference in a display area in that period respectively. The lengths of the impulse operation periods C are changed and plotted and A to F in FIG. 10 correspond to a case where driving is performed with waveforms of A to F in FIG. 9. FIG. 9 illustrates that in-plane brightness differences are different, depending upon a driving pattern.

As illustrated in FIG. 10, in order to suppress in-plane brightness differences, it is sufficient that an impulse operation period having a different length from other impulse operation periods exists, and thus such driving that impulse operation periods in the field period are all equal patterns A and E illustrated in FIG. 9 is not required.

As illustrated in patterns C and F of FIG. 9, if at least one impulse operation period of approximately twice as large as other impulse operation periods exists in the field period, such a driving pattern can suppress in-plane brightness differences more than other driving patterns, which is preferable.

However, the present invention does not require that one impulse operation period is exactly twice as long as the impulse operation periods. It is a gist of the present invention to make a brightness difference in a display area smaller than those of drivings E and A in each of which impulse operation periods are all equal.

Accordingly, if the in-plane brightness difference in a display area can be suppressed to less than a middle level of (A) and (C) or (E) and (C) or (A) and (F), technological advantages of the present invention can be achieved significantly. The simulation result of FIG. 10 illustrates that the brightness difference is lower than a middle value (B) based on a relationship between (A) and (C) and lower than a middle value (D) based on a relationship between (E) and (C). A setting method for such an impulse operation period is described as follows:

If at least one impulse operation period A and at least one impulse operation period B exist in a field period, $$\text{Impulse operation period } A \times 1/4 \leqq \text{Impulse operation period } B \leqq \text{Impulse operation period } A \times 3/4.$$

If driving is performed with a light-emission control signal having an impulse operation period satisfying this relationship, an in-plane brightness difference can be suppressed, thus attaining excellent display.

As described above, the present invention can attain the technological advantages thereof if the length of a certain impulse operation period is different from that of other impulse operation period. In addition, one impulse operation period having a length approximately twice as long as the other impulse operation periods provides more preferable technological advantages and can suppress brightness differences in a light emission area, thus attaining excellent display.

Fourth Embodiment

The overall configuration of a display apparatus according to the present embodiment is the same as that of FIG. 1. A pixel circuit 2 and a drive method therefor are the same as those of FIGS. 2 and 3 and an example of a timing chart describing the drive method is the same as those of FIG. 4 and therefore description and drawings thereof will be omitted.

Figure 11:
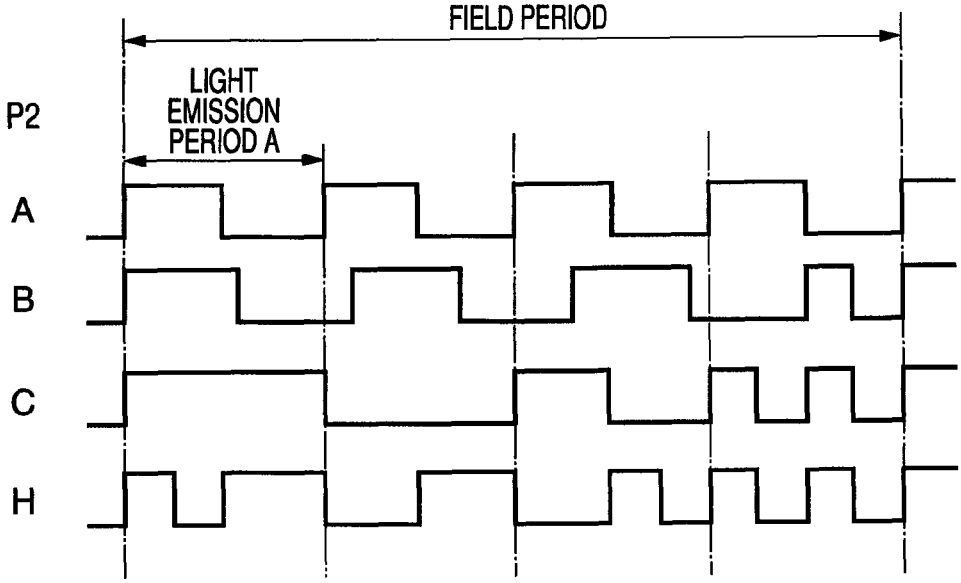
FIG. 11 is a view illustrating an example of a light emission pattern of a drive method according to the present invention.

Patterns A and B in FIG. 11 are the same as patterns A and C in FIG. 8. Patterns G and H are an example of a waveform of a light-emission control signal P2 having a plurality of impulse operation periods in a field period to change an impulse operation period with a duty ratio being maintained. A pattern G has three types of impulse operation periods (a first impulse operation period, a second impulse operation period and a third impulse operation period).

The present invention is one example of a drive method in which a plurality of impulse operation periods is changed.

Figure 12:
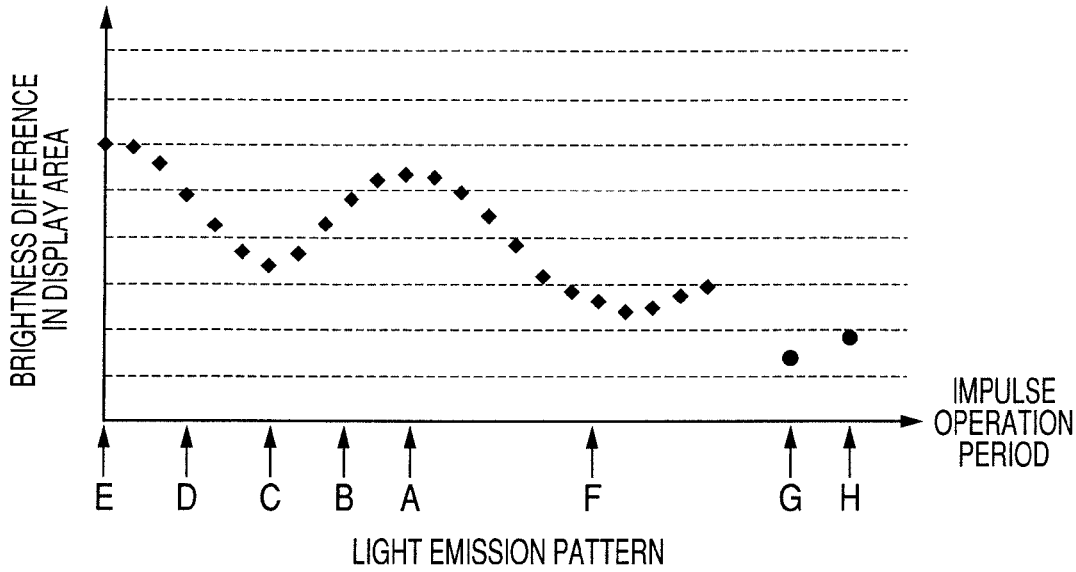
FIG. 12 is a view illustrating one example of technological advantages of the present invention attained by driving in FIG. 11.

Patterns A to F in FIG. 12 illustrate the same positions as a case where driving is performed with waveforms of patterns A to F in FIG. 9. Patterns G and H in FIG. 12 have no meanings on the horizontal axis and have plots on the same graph for comparison with patterns A to F. Patterns G and H in FIG. 12 have in-plane brightness differences smaller than patterns A to F, as shown in the figure. Patterns A to F have only one changed period of a plurality of impulse operation periods in a field period, respectively, but for Patterns G and H, a light-emission control signal P2 is set so that the lengths of more impulse operation periods are changed and in-plane brightness differences are made smaller.

Light emitting elements on respective scanning lines may be driven with waveforms of random patterns such as M series.

As described above, the present embodiment is structured so that the length of a certain impulse operation period is different from those of the other impulse operation periods, which provides more preferable technological advantages of the present invention even if a plurality of impulse operation periods which have changed in length exist. Hence, brightness differences in light emission area can be suppressed, thus attaining excellent display.

The following embodiments 5 and 6 eliminate fluctuations in power source current of a display apparatus performing impulse operation as well as unevenness of brightness caused by fluctuations in power source current.

Fifth Embodiment

A display apparatus according to the present embodiment is the same display apparatus illustrated in FIG. 1 used in the first embodiment, and uses the same pixel circuit as in FIG. 2. The operation is the same as illustrated in FIG. 3. Of the configurations and operations of the present embodiment, description of the same ones as in the first embodiment will be omitted.

Figure 13:
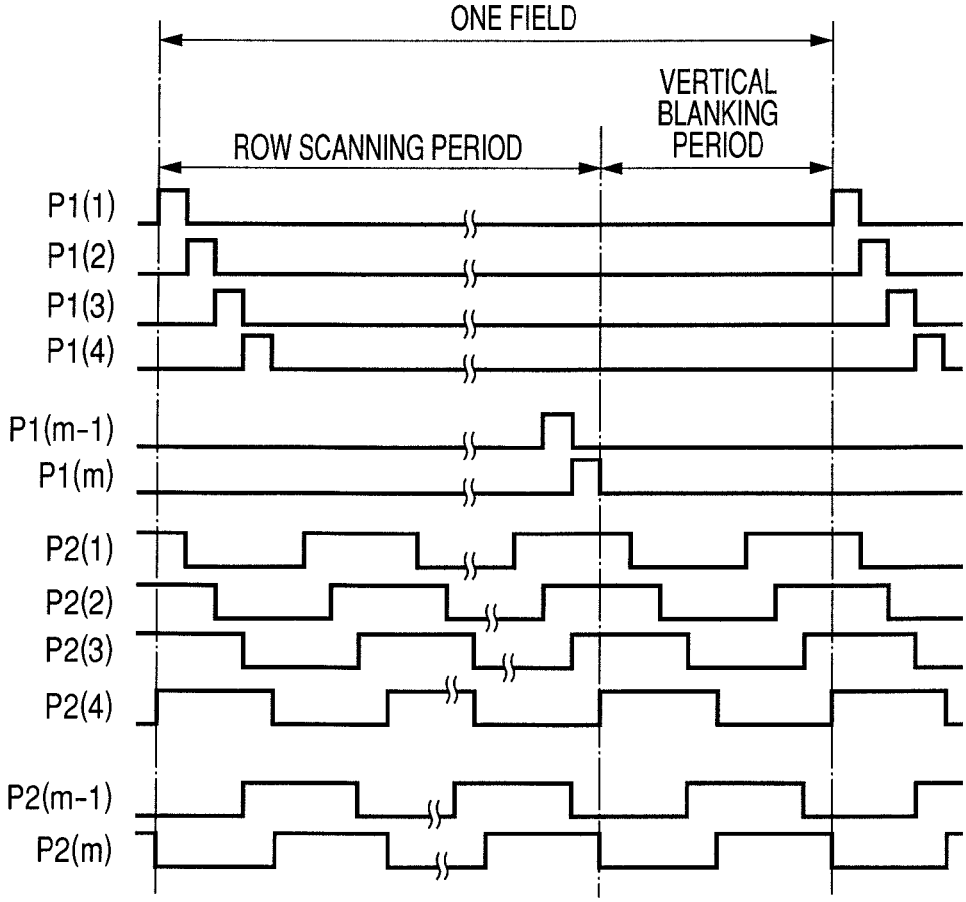
FIG. 13 is a timing chart illustrating operation of another display apparatus of the present invention.

FIG. 13 is an example of a timing chart illustrating a drive method of a display apparatus in the present embodiment.

P1(1) to P1(*m*) in FIG. 13 illustrate scanning signals applied to scanning lines of 1st to m-th rows in FIG. 1. In addition, P2(1) to P2(*m*) illustrate light-emission control signals P2 corresponding to each of 1st to m-th rows.

In the row scanning period, scanning signals P1(1), P1(2), P1(3), . . . P1(*m*) of 1st, 2nd, 3rd to m-th rows are sequentially kept at a high level on the one scanning period basis, respectively. In the high level period, a gradation display data Vdata is input into the pixel circuit 2.

The light-emission control signal P2, after the gradation display data Vdata is input, becomes a low level period for light emission. Subsequently, a high level period is made to attain a non-light emission state. During one field period, light emission and non-light emission are repeated.

In the present embodiment, an impulse operation period is 1/N (N: 1 or an integer larger than 1) of one field period and set to be equal to a vertical blanking period.

When one field period is not integer times of the vertical blanking period, the one field period is not integer times of the impulse operation period. At that time, as described below, two different impulse operation periods may be combined to provide one field period.

For example, if ΔN=Field period/vertical blanking period is taken, a value obtained by rounding off all digits to the right of the decimal point is taken as ΔN'. If a value obtained by discarding or rounding up all digits to the right of the decimal point of TSx as TSx=Field period/ΔN' is taken as Txs' (a first impulse operation period), it is sufficient that a period difference to TSx' is a light emission pattern expressed in a combination of an impulse operation period (a second impulse operation period) within the range of "Field period-TSx'×M" and TSx'. Where M is an integer which sets "Field period-TSx'×M" at a minimum more than zero.

In other words, when the field period is not integer times of vertical blanking period, the following steps may be taken. Specifically, the field period is divided by an integer obtained by rounding off a quotient obtained by dividing the field period by a vertical blanking period. A period rounded to integer by rounding up or discarding a period obtained by this division is taken as A period. A period which is longer than a value obtained by subtracting, from the A period, a remainder obtained by dividing a field period by the A period and which is shorter than the A period, is taken as B-period. A light emitting element of each scanning line may be driven by a combination of A-period pattern and B-period pattern.

In any case, a duty ratio of a light emission pattern is 50%.

A-period or B-period may be divided into a plurality of segments.

Figure 14:
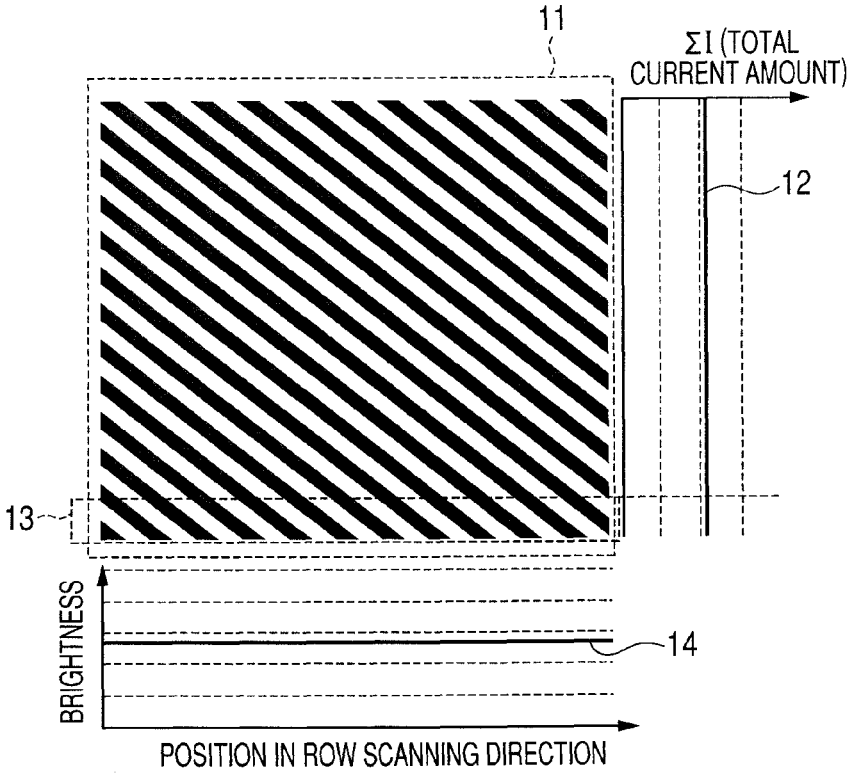
FIG. 14 is a view illustrating a light emission pattern, power source fluctuations and brightness changes in the operation of FIG. 13.

FIG. 14 illustrates how total current fluctuation in display area depending upon a light emission timing and corresponding brightness changes are seen on the display apparatus in the present embodiment.

The horizontal direction of a pattern of a reference numeral 11 illustrates a row scanning direction position and the vertical direction thereof illustrates time. A white color portion shows light emission and a black color portion shows non-light emission. A TS signal is illustrated in black and white pattern on the left end of reference number 11. A portion denoted by reference numeral 13 is a vertical blanking period. Seeing the left end portion of a blanking period, it indicates that an impulse operation period with a combination of the white color portion and the black color portion meets a blanking period.

The total current amount at a moment is expressed by total amount of white color portions at a certain position in a horizontal direction and therefore the magnitude thereof is as indicated by reference numeral 12. At any time within reference numeral 11, a total amount of white color portions are equal, which means that total current amount is always constant.

Since there are no current fluctuations, power fluctuations do not occur, and at any position and time, light emission brightness remains constant. Light emission amount integrated for one field period is a straight line denoted by reference numeral 14. It is obvious that there are no changes in brightness at positions in a row scanning direction, thus attaining excellent image quality.

It is assumed that an image signal is generated by an NTSC signal. In this case, one field period can take 262 or 263 scanning period. At this time, if the display area is 240 rows, the vertical blanking period is 22 or 23 scanning period.

At this time, it is desirable to set the impulse operation period to be approximately equal to a vertical blanking period and to approximately 1/N of one field period, and therefore the one field is set to 262 scanning period and N is calculated first.

$$N=262/22=11.9\approx 12$$

Using this value, when an impulse operation period is determined, $$262/12=21.8\approx 22$$

In 262 scanning period, the impulse operation period close to 262/N is 22 scanning period at N=12.

At this time, $$22\times 12=264$$

Because of exceeding the field period, 22 scanning period×11 times+20 scanning period× once.

Otherwise, 22 scanning period×10 times+21 scanning period× twice

Adjustment may be made in such a range that impulse operation period hardly change.

If 263 scanning period is taken as one field, $N=263/23=11.4\approx 11$, $263/11=23.9\approx 24$ In 263 scanning period, the impulse operation period next to 263/N is 24 scanning period at N=11.

At this time, $24\times 11=264$

Because of exceeding the field period, 24 scanning period×10 times+22 scanning period× once.

Otherwise, 24 scanning period×9 times+23 scanning period× twice.

Adjustment may be made in this way.

Accordingly, setting the impulse operation period to approximately 22 or 24 scanning period is one embodiment which provides the advantage of the present invention.

If another display apparatus, for example, one field period is 262 scanning period and a display area is 200 rows, $N=262/62=4.23\approx 4$, $262/4=65.5\approx 66$.

The impulse operation period nearest to 262/N in the display apparatus is 66 scanning period.

At this time, $4\times 66=264$

Because of exceeding the field period, 66 scanning period×3 times+64 scanning period× once.

Otherwise 66 scanning period×2 times+65 scanning period× twice

Adjustment may be made in this way.

The present embodiment exemplifies a display apparatus having the configuration of FIG. 1, but is not limited thereto, provided that the structure can implement a drive method in FIG. 13.

As described above, the present embodiment is configured so that an impulse operation period is approximately 1/N times as large as a field period and is approximately equal to a vertical blanking period. Accordingly, an impulse operation period completion timing at the last of a field period at each row and an impulse operation period start timing of the next field period are made almost continuous. In addition, an impulse operation period at the display area last row and an impulse operation period at the display area first row are made almost continuous, which should be usually discontinuous due to the presence of a vertical blanking period. Accordingly, a light emission area in a display area is always equal, thus stabilizing current amount flowing into the display area. Hence, power source fluctuations by power source impedance as well as brightness changes in the display area can be suppressed for excellent display.

Sixth Embodiment

The overall configuration of a display apparatus according to the present embodiment is the same as that of FIG. 1. A pixel circuit 2 and a drive method therefor are the same as those of FIGS. 2 and 3 and therefore description and drawings thereof will be omitted.

Figure 15:
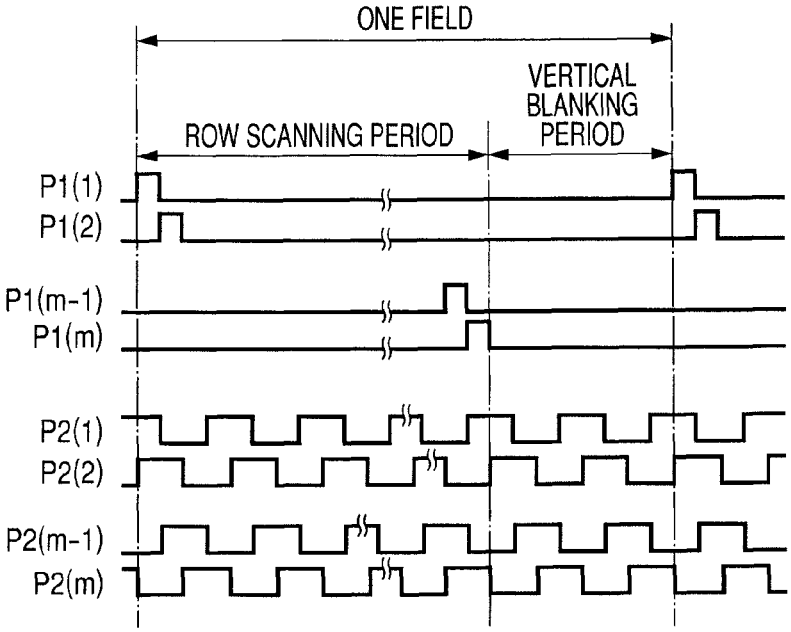
FIG. 15 is a timing chart illustrating still another example of the operation of another display apparatus of the present invention.

FIG. 15 is an example of a timing chart illustrating a drive method of a display apparatus in the present embodiment.

P1(1) to P1(*m*) in FIG. 15 illustrate scanning signals applied to scanning lines of 1st to m-th rows in FIG. 1. P2(1) to P2(*m*) show a light-emission control signal P2 corresponding to each of 1st to m-th rows. A difference from the drive method described in the timing chart illustrated in FIG. 13 is an impulse operation period of a light-emission control signal P2.

A light-emission control signal P2 in the present embodiment is set such that an impulse operation period is approximately 1/n times (n: 1 or an integer larger than 1) as large as a vertical blanking period. The timing chart of FIG. 15 illustrates a case of n=2.

Figure 16:
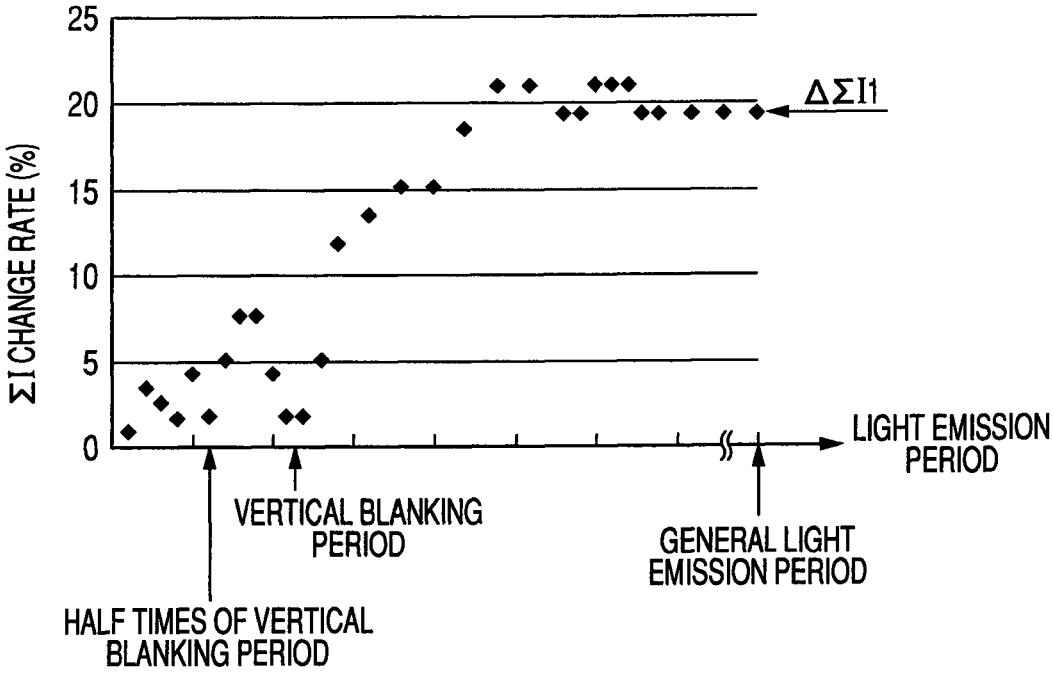
FIG. 16 is a view illustrating one example of a range to which a drive method according to the present invention is applicable.

FIG. 16 is a graph obtained by calculating ΣI change rate (=(ΣI maximum−ΣI Minimum)/ΣI average value) when an impulse operation period is changed and illustrates one example of the present embodiment. FIG. 16 shows a result of the whole-surface display in one field period with 262 scanning period, 240 display rows and 50% duty ratio. At this time, as a general impulse operation period, ΣI change rate in driving one impulse operation in one field period is taken as ΔΣI1. ΣI change rate in driving N-time impulse operation in one field period is taken as ΔΣIN.

By setting an impulse operation period so that ΔΣIN is less than a half as large as ΔΣI1, a sufficient technological advantages of the present invention can be attained.

Figure 17:
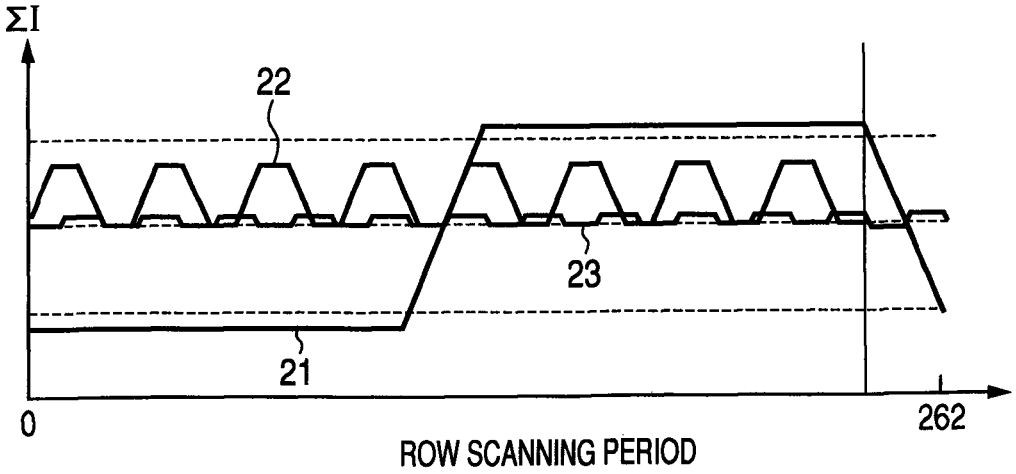
FIG. 17 is a view illustrating one example of technological advantages of a drive method according to the present invention.

Reference numeral 21 in FIG. 17 denotes simulation of ΣI time change in driving one impulse operation in one field period. Reference numeral 22 denotes simulation of ΣI time change driven with impulse operation period as ΔΣIN which is less than a half as large as ΔΣI1. Further, reference numeral 23 denotes simulation of ΣI time change provided when an impulse operation period and a vertical blanking period are approximately equal to each other. By selecting an impulse operation period which makes ΣI time change to be less than a half as illustrated in reference numeral 22 even if the impulse operation period is not such an impulse operation period so as to completely eliminate ΣI time change, the technological advantages of the present invention can be significantly attained.

More preferably, in FIG. 16, there are the following examples as an impulse operation period at which ΣI change rate is smaller than peripheral impulse operation periods: Specifically, one example is an impulse operation period within such a range that a value of (one field period)/(impulse operation period) is approximately an integer and within such a range that an impulse operation period is approximately 1/n times (n: 1 or an integer larger than 1) of a vertical blanking period. An impulse operation period at which ΣI change rate is small does not need to meet 1/n times as large as a vertical blanking period and as long as it is neighbor thereof, which can significantly suppress current change amount, thus significantly attaining the technological advantages of the present invention.

As a more preferable example, FIG. 16 illustrates impulse operation periods of n=1 (an arrow at a position of an impulse operation period on horizontal axis=vertical blanking period) and n=2 (an arrow at a position of an impulse operation period on horizontal axis=vertical blanking period) as an example in which an impulse operation period on the horizontal axis meets approximately 1/n times as large as a vertical blanking period. ΣI change rate in these impulse operation periods is smaller than in other impulse operation periods and therefore even selection of such an impulse operation period can attain an advantage of the present invention.

As described above, the present embodiment can suppress power source fluctuations as well as brightness fluctuations of a self-luminous element, thus attaining excellent display, provided that the impulse operation period is 1/N times as large as a field period and ΣI change is small even if the impulse operation period does not meet a vertical blanking period.

The fifth and sixth embodiments above are configured so that impulse operation periods are set to be around 1/N (N: natural number) as large as the vertical blanking period.

As a method for eliminating ΣI change, in addition to the above, there is another method for changing power source voltage, increasing power source voltage during the period in which the number of light emission rows is larger than that of non-light emission rows, or reversely decreasing power source voltage meeting with a period in which the number of light emission rows is smaller than that of non-light emission rows. Specifically, power source voltage is fluctuated synchronously with a light emission pattern to control so as to be a constant ΣI.

Means for compensating for brightness distribution with ΣI fluctuation itself existing may be taken. A place with low brightness caused by ΣI fluctuation is determined depending on an impulse operation period and a blanking period, which place is fixed at a specific place of a display area. By disposing an element having higher current-brightness characteristic than the surrounding at that position, that is, an element emitting brighter light relative to the same current, brightness distribution can be compensated. The brightness distribution by the characteristic of a light emitting element and the brightness distribution generated by synchronizing ΣI change with light emission pattern are cancelled by each other to generate uniform brightness.

By converting an image data which light-emits a place having low brightness to an image data making brighter light emission, brightness distribution can be compensated.

Power source voltage is supplied to respective pixel circuits through a Vcc wiring line provided in a row direction as illustrated in FIG. 2. By adjusting the impedance of the wiring on the row basis and making distribution to power source voltage supplied to a pixel, brightness distribution parallel to rows can be generated. This is one of methods of compensating brightness distribution by ΣI fluctuations.

As describe above, by compensating ΣI changes with power source voltage fluctuations or brightness distribution previously prepared on a panel, uniform display apparatus can be attained.

Eighth Embodiment

The present embodiment is one of examples where the respective embodiments described above are applied to electronic apparatuses.

Figure 18:
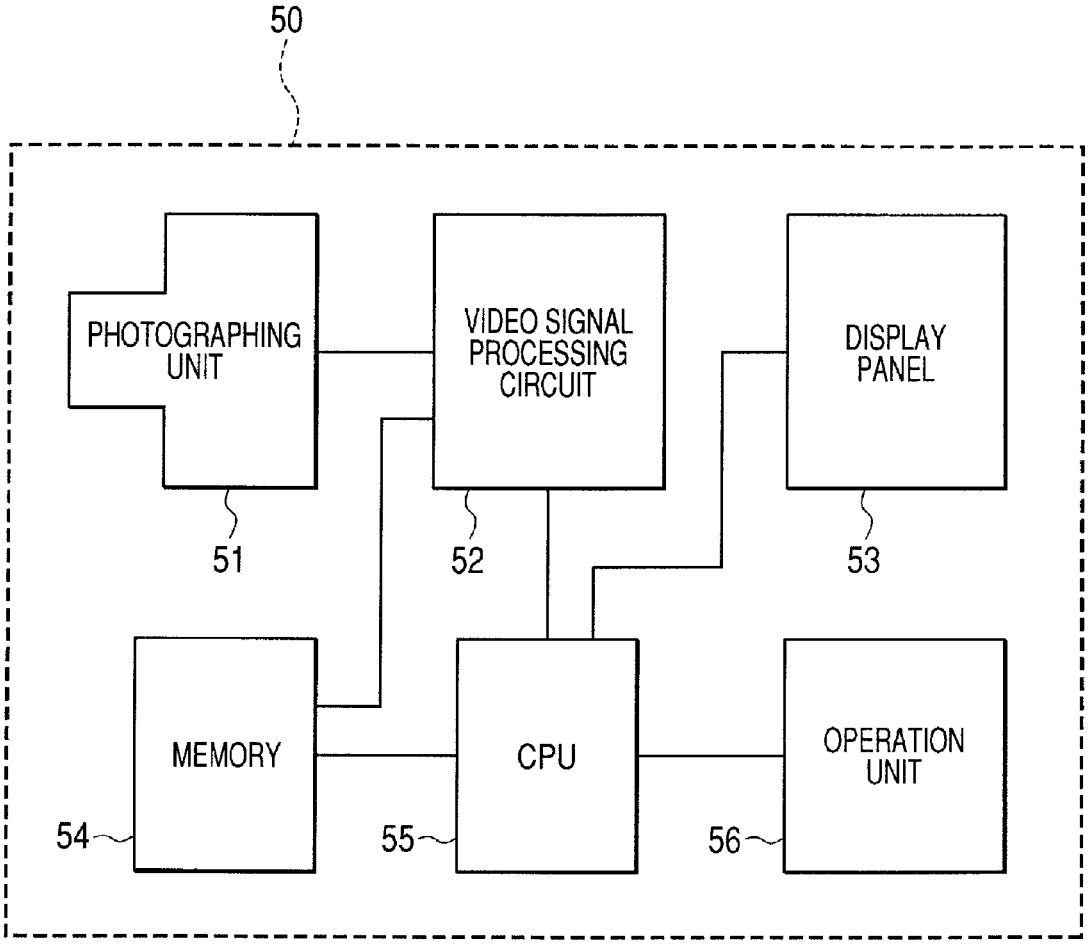
FIG. 18 is a block diagram illustrating an overall configuration of a digital still camera system using a display apparatus according to the present invention.
Figure 19:
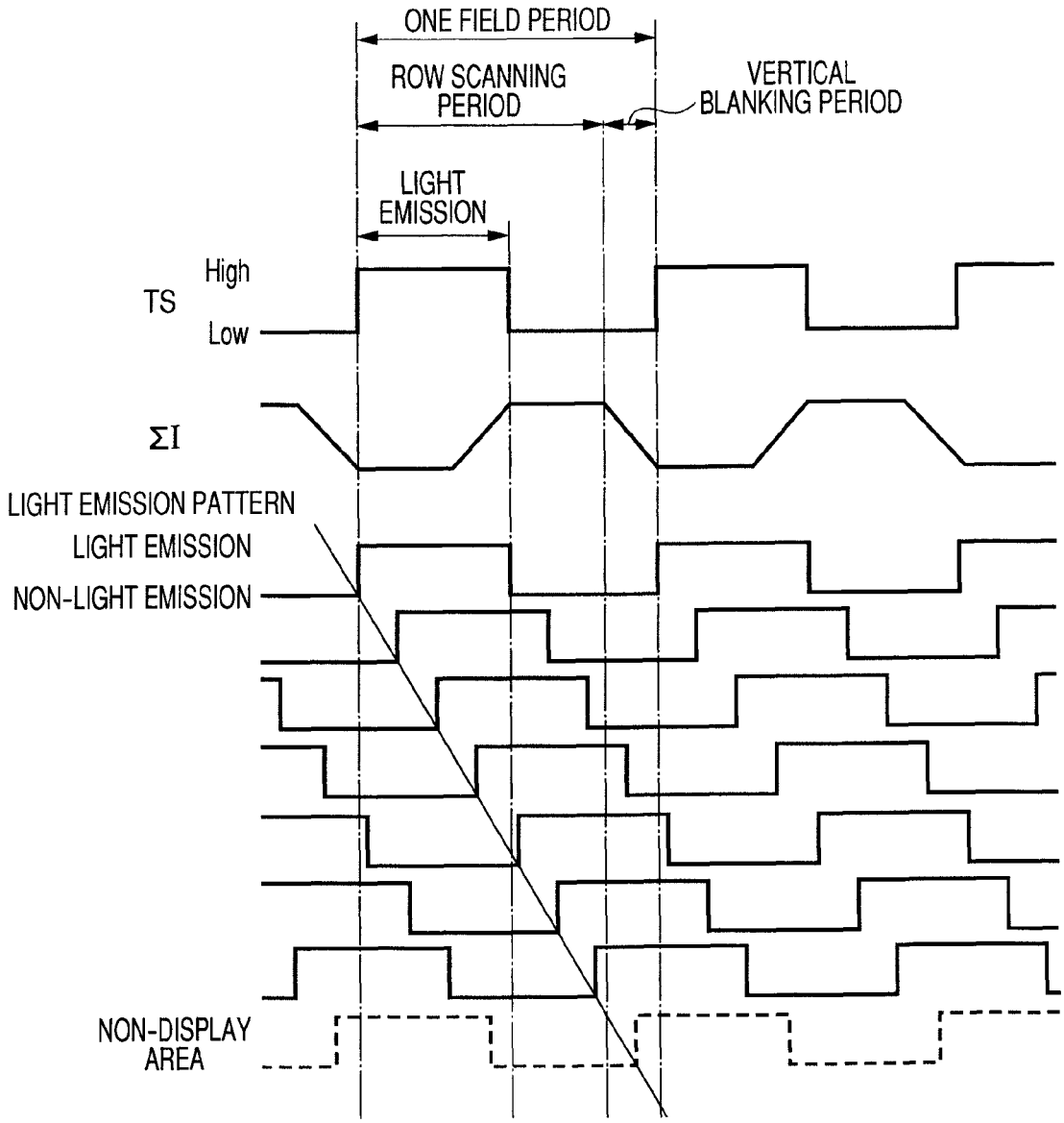
FIG. 19 is a view illustrating a light emission pattern and electric current amount change in a display apparatus under duty driving.
Figure 20:
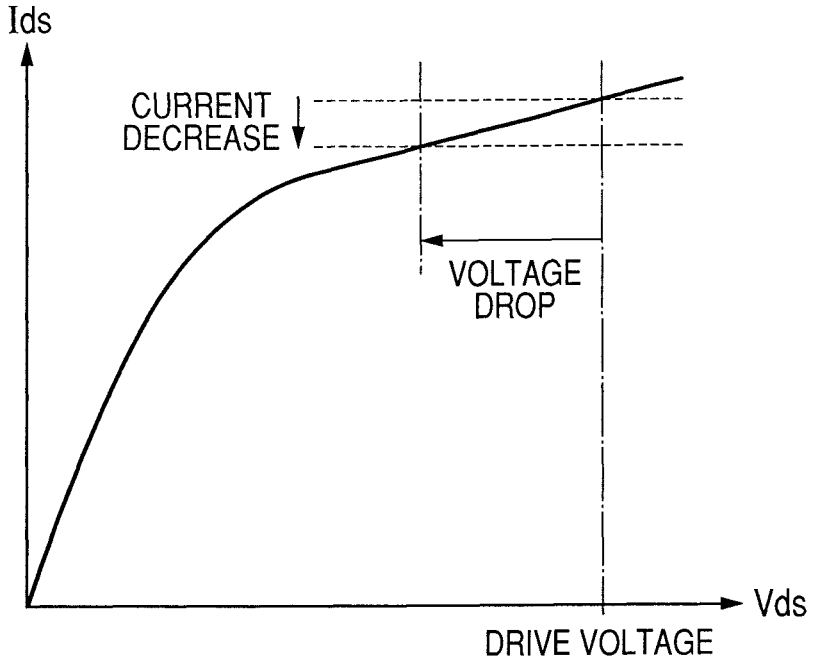
FIG. 20 is a view illustrating TFT characteristics having an influence upon image quality of a display apparatus.
Figure 21:
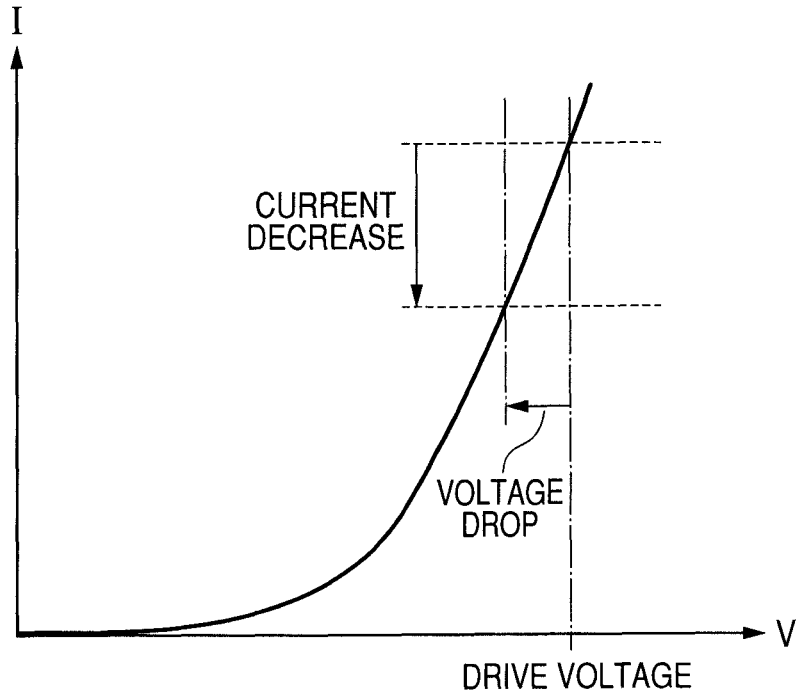
FIG. 21 is a view illustrating EL characteristics having an influence upon image quality of a display apparatus.
Figure 22:
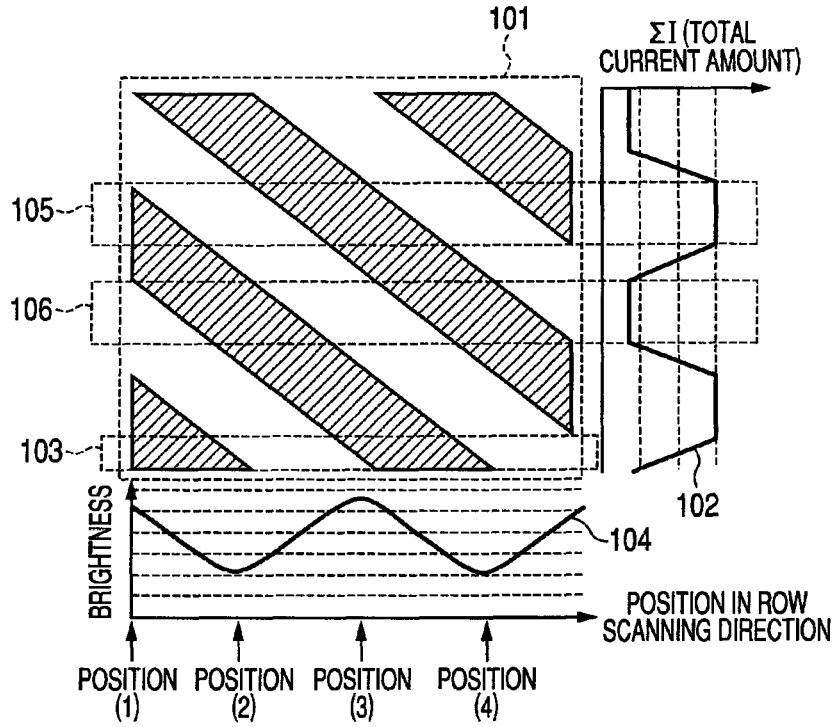
FIG. 22 is a view illustrating a relationship between a light emission pattern and power source fluctuations and brightness changes of a display apparatus.

FIG. 18 is a block diagram of one example of a digital still camera system of the present embodiment. In FIG. 18, reference numeral 50 denotes a digital still camera system, reference numeral 51 denotes a photographing unit, reference numeral 52 denotes a video signal processing circuit, reference numeral 53 denotes a display panel, reference numeral 54 denotes a memory, reference numeral 55 denotes CPU and reference numeral 56 denotes an operation unit.

In FIG. 18, a video photographed by a photographing unit 51 or a video recorded in a memory 54 is signal-processed by a video signal processing circuit 52 and can be viewed on a display panel 53. CPU55 controls the photographing unit 51, the memory 54 and the video signal processing circuit 52 in accordance with an input from the operation unit 56 to attain photographing, recording, replaying and displaying suitable to situations. The display panel 53 can be also utilized as display units for various electronic apparatuses.

While the present invention has been described with reference to exemplary embodiments, it is to be understood that the present invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-214795 filed on Aug. 21, 2007, and Japanese Patent Application No. 2007-229248 filed on Sep. 4, 2007, which are hereby incorporated by reference herein in their entirety.

The invention claimed is:

1. A display apparatus, comprising:

a plurality of light emitting elements arranged in a row direction and in a column direction;

a plurality of drive circuits provided for driving the light emitting elements;

a plurality of scanning lines extending in the row direction, to which a scanning signal is applied to select the drive circuits on a row basis;

a plurality of control lines extending in the row direction, to which a light-emission control signal is applied to determine an emission period of the light emitting elements; and a plurality of data lines extending in the column direction, to which image signals are applied to define brightness of the light emitting elements on a column basis, the scanning signal being sequentially applied to the scanning lines in a field so that the image signals of the data lines are programmed in the drive circuits, the light-emission control signal being sequentially applied to the control lines to make the light emitting elements emit light with brightness corresponding to the image signal programmed to the drive circuit, wherein an impulse operation constituted by a high level and a low level of the light-emission control signal, which corresponds to on and off of the light emission element, respectively, is repeated at least twice in different temporal patterns in a period from programming of the image signal necessary for display of one image to inputting of the next image signal.

2. The display apparatus according to claim 1, wherein the impulse operations repeated in a field have different lengths.

3. The display apparatus according to claim 2, wherein the impulse operations have a duty ratio of 50%.

4. The display apparatus according to claim 1, wherein the impulse operations in the field have different duty ratios.

5. The display apparatus according to claim 1, wherein a third impulse operation is included in the field.

6. The display apparatus according to claim 1, wherein an impulse operation has a period longer than ¼ and shorter than ¾ of a period of another impulse operation in the field.

7. The display apparatus according to claim 1, wherein an impulse operation has a period twice as large as another impulse operation in the field.

8. A display apparatus comprising:

light emitting elements arranged in a row direction and in a column direction;

a drive circuit provided in each of the light emitting elements and driving the light emitting elements;

a scanning line which is supplied with a scanning signal to select the drive circuit on a row basis;

a control line which is supplied with a light-emission control signal to control a period during which the drive circuit drives the light emitting element; and a data line for supplying an image signal to the drive circuit arranged in the column direction, wherein the scanning signal is sequentially applied to the scanning line at a period of one field so that an image signal of the data line is programmed in the drive circuit, and wherein the light-emission control signal is applied to the control line at a timing shifted on the row basis so that the light emitting element emits light, wherein the period of one field includes a vertical blanking period in a period from completion of scanning of all the scanning lines to the start of the next scanning, and wherein an impulse operation period of a light emission pattern of the light emitting element corresponding to a waveform of the light-emission control signal is approximately 1/N times, with N being 1 or an integer larger than 1, as long as a field period and is approximately equal to the vertical blanking period and wherein the impulse operation constituted by a high level and a low level of the light-emission pattern, which corresponds to on and off of the light emission element, respectively, is repeated at least twice in different temporal patterns in a period from programming of the image signal necessary for display of one image to inputting of the next image signal.

9. The display apparatus according to claim 8, wherein one field period is integer times as large as the vertical blanking period, and wherein the light emission pattern of the light emitting element has an impulse operation period of 1/N, with N being 1 or an integer larger than 1, of one field period.

10. The display apparatus according to claim 8, wherein the duty ratio of the impulse operation period is 50%.

11. A drive method of a display apparatus including light emitting elements arranged in a row direction and in a column direction, a drive circuit provided in each of the light emitting elements, which drives the light emitting elements, a scanning line which is supplied with a scanning signal to select the drive circuit on a row basis, a control line which is supplied with a light-emission control signal to control a period during which the drive circuit drives the light emitting element, and a data line for supplying an image signal to the drive circuit arranged in the column direction, wherein the scanning signal is sequentially applied to the scanning line in a period of one field so that an image signal of the data line is programmed in the drive circuit, and wherein the light-emission control signal is applied to the control line at a timing shifted on the row basis so that the light emitting element emits light, an impulse operation period of a light emission pattern of the light emitting element corresponding to a waveform of the light-emission control signal and wherein the impulse operation constituted by a high level and a low level of the light-emission pattern, which corresponds to on and off of the light emission element, respectively, is repeated at least twice in different temporal patterns in a period from programming of the image signal necessary for display of one image to inputting of the next image signal.

12. A drive method of a display apparatus including light emitting elements arranged in a row direction and in a column direction, a drive circuit provided in each of the light emitting elements, which drives the light emitting elements, a scanning line which is supplied with a scanning signal to select the drive circuit on a row basis, a control line which is supplied with a light-emission control signal to control a period during which the drive circuit drives the light emitting element, and a data line for supplying an image signal to the drive circuit arranged in the column direction, wherein the scanning signal is sequentially applied to the scanning line at a period of one field so that an image signal of the data line is programmed in the drive circuit, and wherein the light-emission control signal is applied to the control line with a timing shifted on the row basis so that the light emitting element emits light, the drive method being arranged so that the period of one field includes a vertical blanking period in a period from completion of scanning of all the scanning lines to start of the next scanning, and an impulse operation period of a light emission pattern corresponding to a waveform of the light-emission control signal is approximately 1/N times, with N being 1 or an integer larger than 1, as long as a field period and is approximately equal to the vertical blanking period and wherein the impulse operation constituted by a high level and a low level of the light-emission pattern, which corresponds to on and off of the light emission element, respectively, is repeated at least twice in different temporal patterns in a period from programming of the image signal necessary for display of one image to inputting of the next image signal.

* * * * *

UNITED STATES PATENT AND TRADEMARK OFFICE

CERTIFICATE OF CORRECTION

PATENT NO. : 8,497,885 B2
APPLICATION NO. : 12/520726
DATED : July 30, 2013
INVENTOR(S) : Kouji Ikeda et al.

It is certified that error appears in the above-identified patent and that said Letters Patent is hereby corrected as shown below:

On the Title Page please correct the Assignee name as follows:

At Item (73) Assignee: "CANON KABUSHIKI KARSHA" should read

--CANON KABUSHIKI KAISHA--

Signed and Sealed this
Fifteenth Day of October, 2013

Teresa Stanek Rea
*Deputy Director of the United States Patent and Trademark Office*